US010612277B2

(12) United States Patent
Yamashita

(10) Patent No.: US 10,612,277 B2
(45) Date of Patent: Apr. 7, 2020

(54) VEHICLE DOOR OPENING/CLOSE DEVICE

(71) Applicant: MITSUI KINZOKU ACT CORPORATION, Yokohama-shi, Kanagawa (JP)

(72) Inventor: Kohei Yamashita, Yokohama (JP)

(73) Assignee: Mitsui Kinzoku Act Corporation, Yokohama-shi (JP)

( * ) Notice: Subject to any disclaimer, the term of this patent is extended or adjusted under 35 U.S.C. 154(b) by 648 days.

(21) Appl. No.: 15/305,357

(22) PCT Filed: Nov. 5, 2014

(86) PCT No.: PCT/JP2014/079314
§ 371 (c)(1),
(2) Date: Oct. 20, 2016

(87) PCT Pub. No.: WO2015/182008
PCT Pub. Date: Dec. 3, 2015

(65) Prior Publication Data

US 2017/0067273 A1 Mar. 9, 2017

(30) Foreign Application Priority Data

May 29, 2014 (JP) ..... 2014-111725

(51) Int. Cl.
*E05B 81/76* (2014.01)
*E05B 79/08* (2014.01)
(Continued)

(52) U.S. Cl.
CPC ..... *E05B 81/76* (2013.01); *E05B 79/08* (2013.01); *E05B 81/06* (2013.01); *E05B 83/40* (2013.01);
(Continued)

(58) Field of Classification Search
CPC ..... Y10T 292/08; Y10T 292/081; Y10T 292/0848; Y10T 292/0849;
(Continued)

(56) References Cited

U.S. PATENT DOCUMENTS 5,893,593 A * 4/1999 Dowling ..... E05B 81/16 292/169.11
6,135,513 A * 10/2000 Hamada ..... E05B 81/20 292/201
(Continued)

FOREIGN PATENT DOCUMENTS

JP 3797250 B 9/2003
JP 4261230 B 10/2004
(Continued)

OTHER PUBLICATIONS

International Search Report Corresponding to PCT/JP2014/079314 dated Jan. 13, 2015.
(Continued)

*Primary Examiner* — Alyson M Merlino
(74) *Attorney, Agent, or Firm* — Davis & Bujold PLLC; Michael J. Bujold

(57) ABSTRACT

A vehicle door opening device that enables a door, in a lock state, to open comprises an operating unit. The operating unit comprises a first outside lever that is pivotally mounted, via a first shaft, and rotates with an outside handle; a second outside lever that is pivotally mounted, via a second shaft that differs from the first shaft, releasing action of the second outside lever is made by a release electric power source, the second outside lever is connected to the first outside lever so that the releasing action is not transmitted to the first outside lever; and a release lever that is pivotally mounted, via the second shaft, and carries out releasing action caused by the releasing action of the second outside lever so that the
(Continued)

releasing action of the releasing lever can be transmitted to door latch units.

8 Claims, 20 Drawing Sheets

(51) Int. Cl.
*E05F 15/643* (2015.01)
*E05B 81/06* (2014.01)
*E05B 83/40* (2014.01)
*E05B 77/26* (2014.01)
*E05B 85/12* (2014.01)

(52) U.S. Cl.
CPC ..... *E05F 15/643* (2015.01); *E05B 77/26* (2013.01); *E05B 85/12* (2013.01)

(58) Field of Classification Search
CPC ..... Y10T 292/0851; Y10T 292/0852; Y10T 292/0853; Y10T 292/0854; Y10T 292/0855; Y10T 292/0857; Y10T 292/0859; Y10T 292/1047; Y10T 292/1078; Y10T 292/1044; Y10T 292/1082; Y10T 292/1055; Y10T 292/1057; Y10T 292/1053; Y10T 292/1054; Y10T 292/1056; Y10T 292/1059; Y10T 292/1076; Y10T 292/108; Y10T 292/106; Y10T 292/57; E05B 81/12; E05B 81/14; E05B 81/16; E05B 81/20; E05B 81/06; E05B 81/76; E05B 83/40; E05B 85/243; E05B 85/12; E05B 79/20; E05B 79/08; E05B 77/26; Y10S 292/23; Y10S 292/46
See application file for complete search history.

(56) References Cited

U.S. PATENT DOCUMENTS

| | | | | |
|---|---|---|---|---|
| 7,438,331 | B2 * | 10/2008 | Wakatsuki | E05B 81/20 292/201 |
| 7,488,014 | B2 * | 2/2009 | Nozawa | E05B 81/06 292/201 |
| 7,540,541 | B2 * | 6/2009 | Yoneyama | E05B 81/20 292/201 |
| 7,591,493 | B2 * | 9/2009 | Nozawa | E05B 81/06 292/201 |
| 7,625,020 | B2 * | 12/2009 | Fujimatsu | E05B 83/36 292/201 |
| 8,613,160 | B2 | 12/2013 | Matsumoto et al. | |
| 2006/0290143 | A1 * | 12/2006 | Watanabe | E05B 81/16 292/216 |
| 2007/0130837 | A1 | 6/2007 | Kusunoki | |
| 2007/0273160 | A1 * | 11/2007 | Fujimatsu | E05B 81/16 292/216 |
| 2016/0123061 | A1 | 5/2016 | Nishikibe et al. | |
| 2017/0183893 | A1 * | 6/2017 | Yamashita | E05B 77/26 |

FOREIGN PATENT DOCUMENTS

| | | | |
|---|---|---|---|
| JP | 4961983 | B | 7/2007 |
| JP | 2009-249836 | A | 10/2009 |
| JP | 2011-132771 | A | 7/2011 |
| JP | 2013-170394 | A | 9/2013 |

OTHER PUBLICATIONS

Written Opinion Corresponding to PCT/JP2014/079314 dated Jan. 13, 2015.

* cited by examiner

VEHICLE DOOR OPENING/CLOSE DEVICE

This application is a National Stage completion of PCT/JP2014/079314 filed Nov. 5, 2014, which claims priority from Japanese patent application serial no. 2014-111725 filed May 29, 2014.

BACKGROUND OF THE INVENTION

The present invention relates to a vehicle door opening device having an outside handle.

In JP2011-132771A1, a regular user with an electronic key approaches a predetermined area around a vehicle in which a locking mechanism is in a lock state. With agreement in checking of an ID signal between a receiver and the electronic key, it is authenticated that the regular user approaches the vehicle. In the authenticated condition, the regular user operates an outside handle on the external side of a sliding door, and an outside-handle detecting switch ("PSD SW" in JP2011-132771A1) detects the operation to perform releasing action of a release actuator. A lift lever in an operating unit ("remote control" in JP2011-132771A1) is moved, and a door latch unit that holds the sliding door closed is released. At the same time or thereafter, the locking mechanism of the operating unit is turned to an unlock state. A motor of an electric door opening device ("power sliding door device") is driven to open the sliding door automatically in a vehicle door opening device.

However, in JP2011-132771A1, in addition to the lock mechanism, there are provided an outside handle lever connected to the outside handle; an opening lever that moves with releasing action of the outside handle lever; a release lever connected to the release actuator and the lift lever connected to the door latch unit. The outside handle lever, the opening lever, the release lever and the lift lever are pivotally mounted on the same shaft, thereby providing complicated structure and increasing axial distance or thickness of the door.

SUMMARY OF THE INVENTION

In view of the disadvantages, it is an object of the present invention to provide a vehicle door opening device that comprises simple structure to enable a locked door to open.

DETAILED DESCRIPTION OF PREFERRED EMBODIMENT

Figure 1:
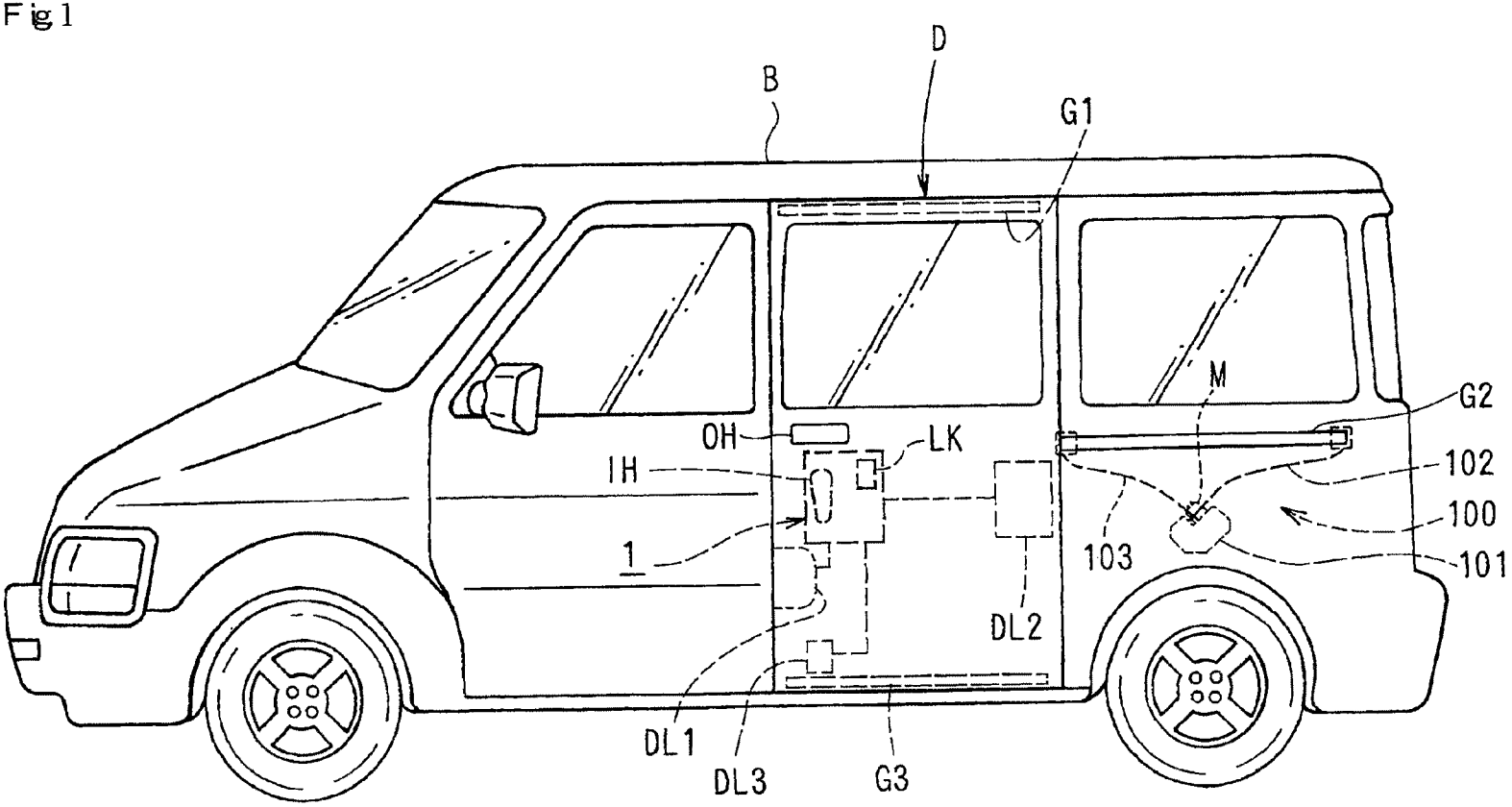
FIG. 1 is a side elevational view to which the present invention is applied.

In FIG. 1, D denotes a sliding door that slides longitudinally of a vehicle body B along an upper guide rail G1, a waist guide rail G2 and a lower guide rail G3.

On an outer panel of the door D, there are an outside handle OH for opening and closing the door D outside the vehicle, and an inside handle IH for opening and closing the door D inside the vehicle and a locking knob LK for turning a locking mechanism, later described, to an unlock state and a lock state manually. There are a fully-open door latch unit DL3 for holding the door D in a fully-open position at the lower part of the door D; a front fully-closed door latch unit DL1 for holding the door D in a closed position at the front part of the door D, and a rear fully-closed door latch unit DL2 for holding the door in a closed position. Within the side of the vehicle body B, there is an electric door opening device 100 for opening and closing the door D electrically.

Inside the door D, there is an operating unit 1 for interconnecting an operation for the outside handle OH and the inside handle IH.

The outside handle OH is pivotally mounted via a vertical shaft on the outer panel of the door D and can be pulled in a grip type in one direction or outward from an initial position or an inoperative position. In order to open and close the door D, the front of a grasping part is gripped and pulled outward, and pulling action is transmitted to the operating unit 1.

The rear fully-closed door latch unit DL2 at the front is known, engages with a front striker (not shown) fixed to the vehicle body and comprises an engagement portion (not shown) for holding the door D in the fully-closed position as shown in a solid line in FIG. 1 and a release portion (not shown) for enabling the door to open from the closed position to release the engagement portion.

The rear fully-closed door latch unit DL2 is known, engages with a rear striker (not shown) fixed to the vehicle body and comprises an engagement portion (not shown) for holding the door D in the closed position with the front fully-closed door latch unit DL1, a closer mechanism (not shown) for operating the engagement portion from a half-latch state to a full-latch state to forcibly close from an ajar state in which the rear striker slightly engages with the engagement portion to a fully-closed state in which the striker fully engages with the engagement portion, a release portion (not shown) for disengaging the engagement portion from the rear striker when the door is opened, and an emergency mechanism (not shown) for forcibly cutting off a connection between the closer mechanism and the engagement portion.

The fully-open door latch unit DL3 is known, engages with a fully-open striker (not shown) fixed to the vehicle body, and comprises an engagement portion (not shown) for holding the door D in the fully-open position and a release portion (not shown) for releasing engagement of the engagement portion to enable the door to close from the fully-open position.

The electric door opening device 100 is known and comprises a door-opening motor M that is a reversible door-opening electric power source, a drive portion 101 that comprises a reversible rotary drum that rotates via a reduction mechanism for slowing down the motor M and an opening cable 102 and a closing cable 103 that are wound on and unwound from the rotary drum. Cables 102, 103 unwound from the rotary drum are wound on a reversible pulley (not shown) supported to the waist guide rail G2 and connected to the door D, and power of the door-opening motor M is transmitted to the door D via the opening cable 102 and the closing cable 103 to open and close the door D. The door-opening motor M is controlled by a control 200 (later described) in the vehicle body.

Figure 2:
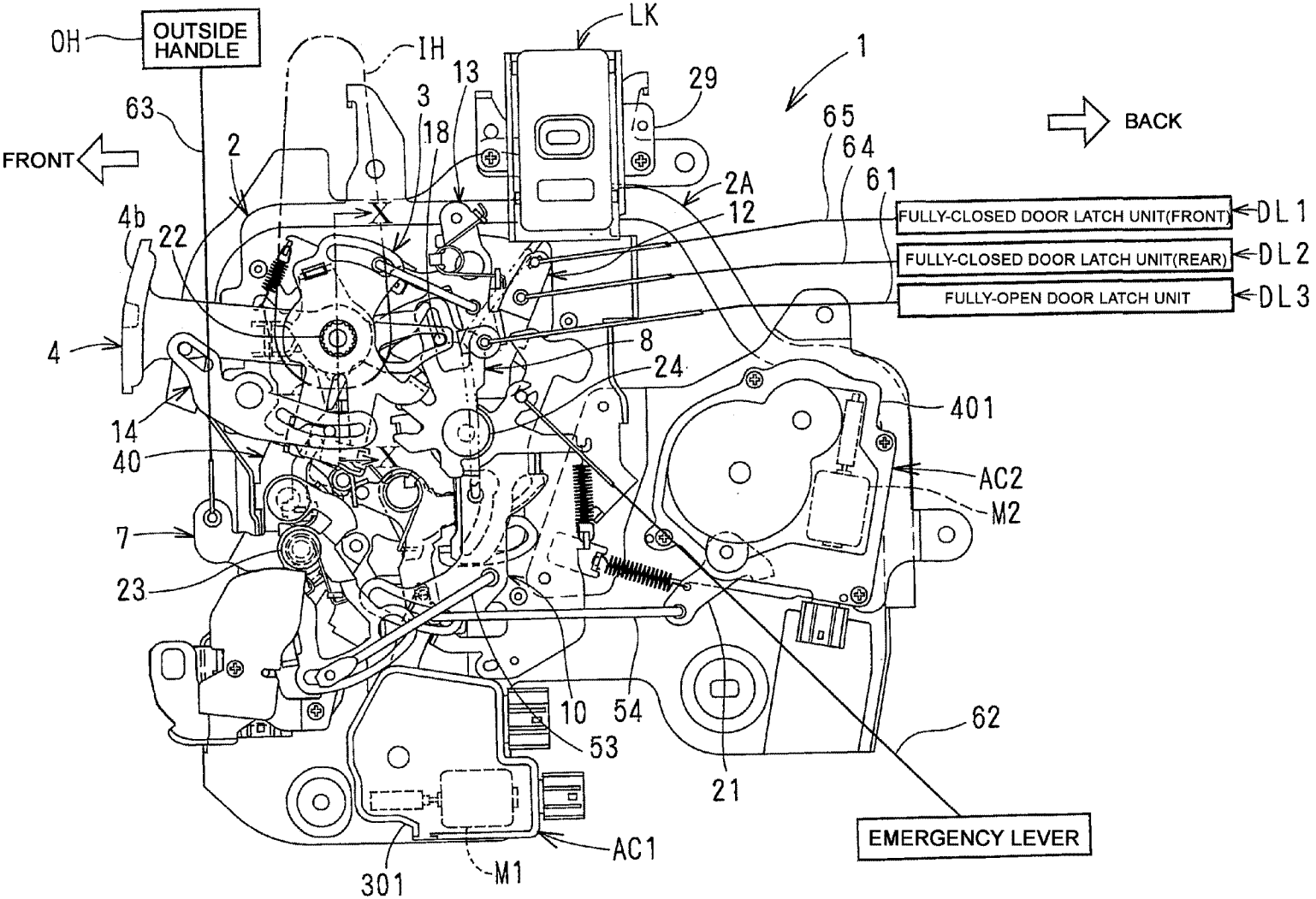
FIG. 2 is a front elevational view of a vehicle door opening device according to the present invention viewed from the interior of the vehicle.
Figure 3:
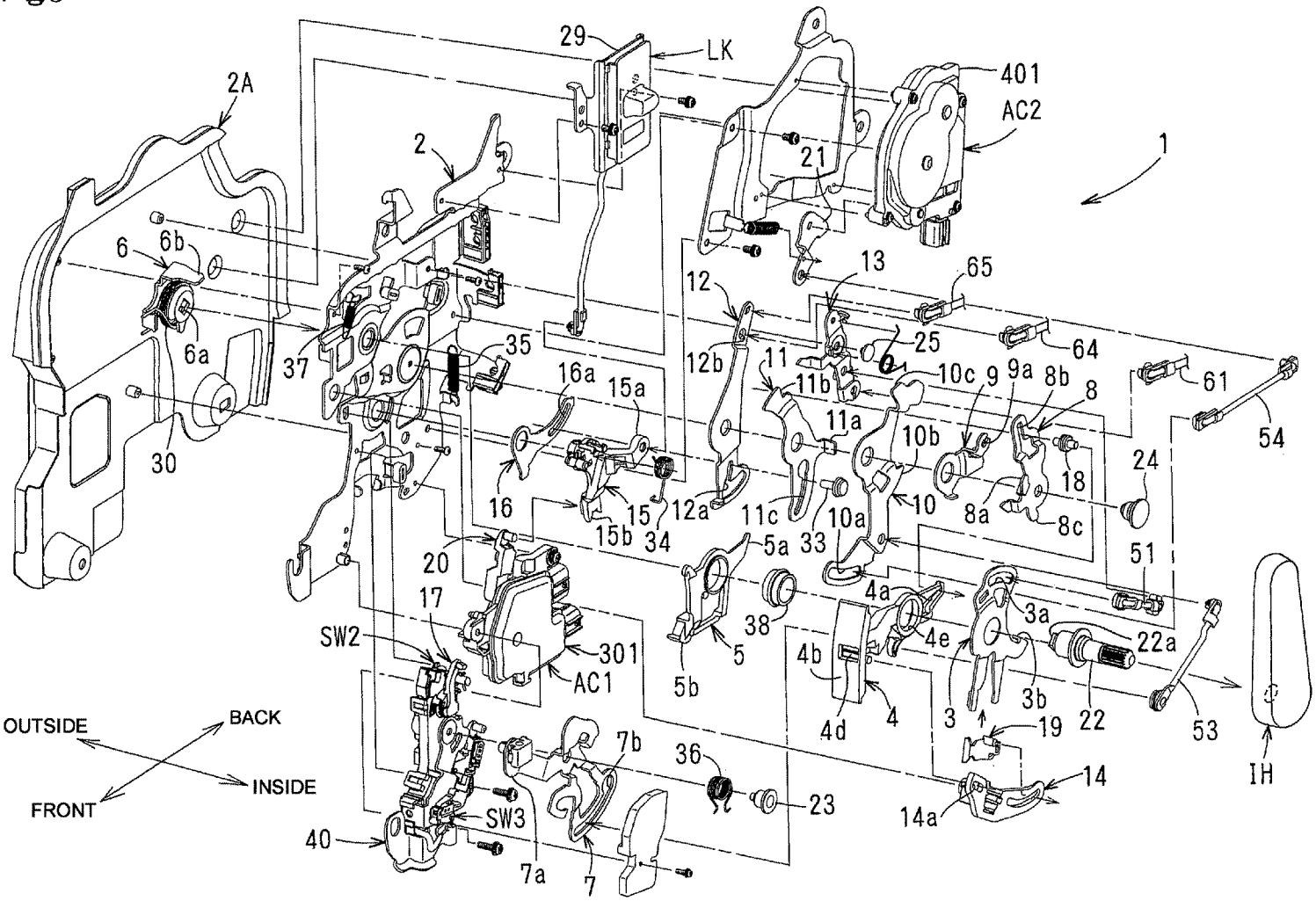
FIG. 3 is an exploded perspective view of the door opening device.

In FIGS. 2 and 3, the operating unit 1 comprises a base member 2 fixed in the door D. At one side facing the interior, the base member 2 comprises the locking knob LK; a locking actuator AC1 that comprises a locking motor M1 as a locking electric power source and an output lever 20 that supplies power of the motor M1; a release actuator AC2 that comprises a release motor M2 as a release electric drive source and an output lever 21 that supplies power of the motor M2; an inside handle shaft 22 that is disposed along a width of the vehicle to enable the inside handle IH to swing along a longitudinal direction of the vehicle; an inside lever 3, a childproof lock lever 4, a switch lever 5 and an inside subsidiary lever 6; a first outside lever 7 that is pivotally mounted via a shaft 23 that is disposed along the width of the vehicle below the inside handle shaft 22; an opening inside lever 8, an emergency lever 9, a second outside lever 10, a subsidiary lever 11 and a release lever 12 that are pivotally mounted via a shaft 24 below the inside handle shaft 22; a closing inside lever 13 that is pivotally mounted via a shaft 25 above the inside handle shaft 22; a childproof lock link 14 that is pivotally mounted via a shaft 26 below the inside handle shaft 22; a first lock lever 15 and a second lock lever 16 that are pivotally mounted via a shaft 27 that are disposed along the width of the vehicle below the shaft 24; an inside-handle-detecting lever 17 that are pivotally mounted to swing along the length of the vehicle below the inside handle shaft 22; an inside-handle detecting switch SW1 (in FIG. 19); a childproof detecting switch SW2; an outside-handle detecting switch SW3; an engagement pin 18 disposed between the opening inside lever 8 and the subsidiary lever 11; and a slider 19 that is slidably supported through the inside lever 3.

The present invention is not limited to the present embodiment, but at least one of the door-opening drive source M, the locking electric drive source M1 and the release electric drive source M2 may be a solenoid instead of the motor.

At the other side of the base member that faces the outside of the vehicle, there is provided a waterproof cover 2A that entirely covers the other side of the base member 2. A signal that is supplied from the inside-handle detecting switch SW1, the childproof detecting switch SW2 and the outside-handle detecting switch SW3 respectively is transmitted to the control 200.

The locking knob LK is supported to slide vertically along a guide bracket 29 fixed to the upper part of the base member 2. Owing to manual operation from the interior of the vehicle, the locking knob LK can move between an unlock position in FIG. 4 where the locking mechanism is in an unlock state and a lock position in FIG. 6 that moves from the unlock position downward at a certain distance where the locking mechanism is in a lock state.

"The locking mechanism" used in this embodiment comprises the first lock lever 15, the second lock lever 16 and an engagement pin 33 (later described). "The unlock state" means that the door D can be opened by an opening action of the outside handle OH and the inside handle IH in an unlock position (later described) when the first lock lever 15, the second lock lever 16 and the engagement pin 33 are disposed in an unlock position (later described), and "the lock state" means that the door D cannot be opened by cancelling the opening action of the outside handle OH and the inside handle IH when the first lock lever 15, the second lock lever 16 and the engagement pin 33 are disposed in a lock position (later described).

"The childproof mechanism" comprises the childproof lock lever 4 and the engagement pin 18. "The childproof unlock state" means a state in which the door D can be opened by the opening action of the inside handle IH when the childproof lock lever 4 and the engagement pin 18 are in a childproof unlock position (later described) and "the locking mechanism" is in "the unlock state", and "the childproof lock state" means a state in which the door cannot be opened by cancelling the opening action of the inside handle IH when the childproof lock lever 4 and the engagement pin 18 are in a childproof lock position and "the locking mechanism" is in "an unlock state".

Figure 18:
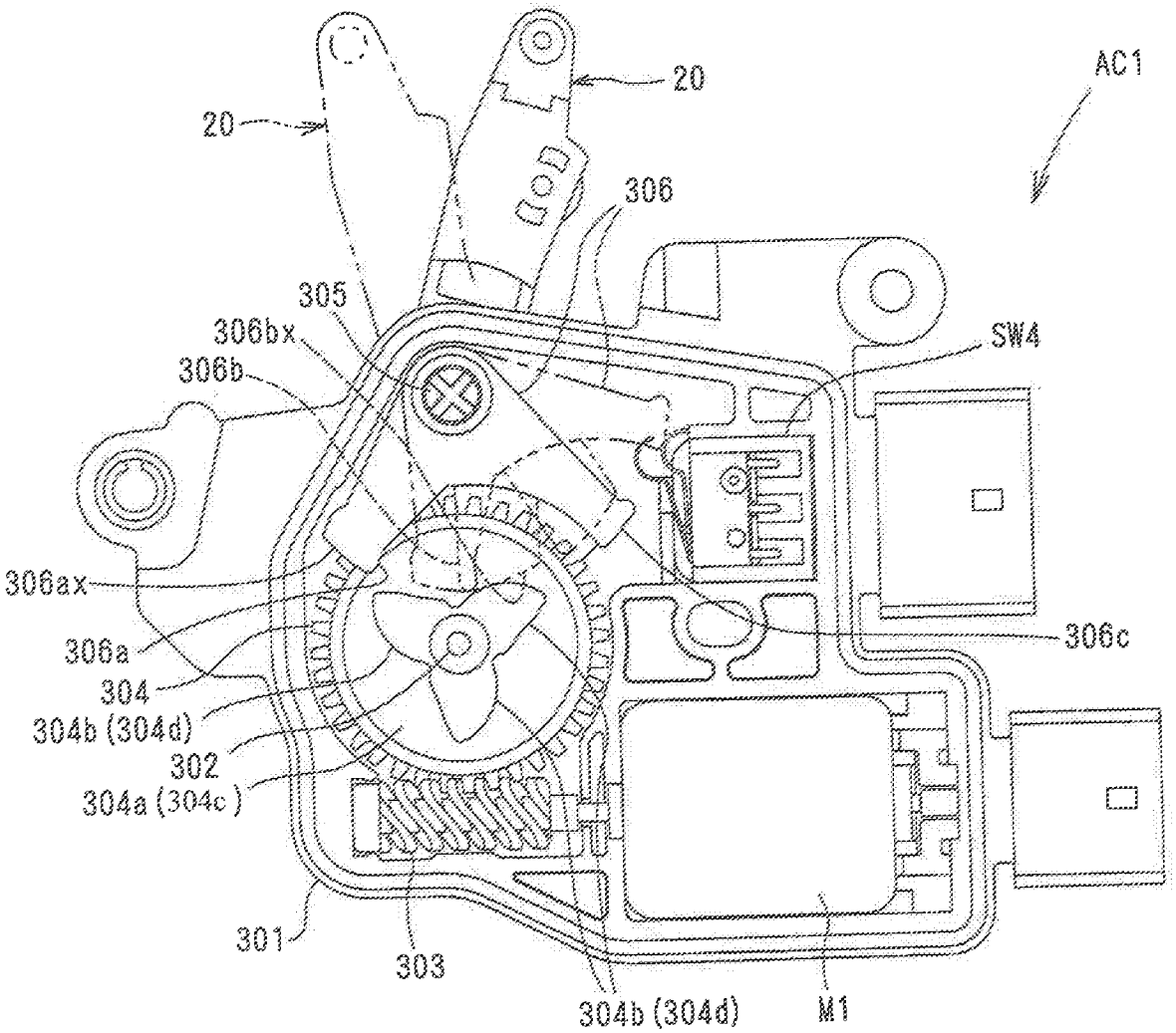
FIG. 18 is a front elevational view showing an internal structure of a locking actuator.

In FIG. 18, in a casing 301 fixed to the lower part of the base member 2, the locking actuator AC1 comprises a locking motor M1; a worm wheel 304 that meshes with the worm 303 fixed to a rotary shaft of the locking motor M1 pivotally mounted via a shaft 302 to slow down rotation of the locking motor M1; an operating lever 306 rotatable between an unlock position (shown with a solid line in FIG. 18) with rotation of the worm wheel 304 pivotally mounted via a shaft 305 and a lock position (shown with a two-dot chain line in FIG. 18) rotated counterclockwise from the unlock position through a predetermined angle; and a lock-detecting switch that can detect the lock position of the operating lever 306. Outside the casing 301, the locking actuator AC1 comprises an output lever 20 that is pivotally mounted to rotate together with the operating lever 301.

The locking motor M1 is controlled by the control 200.

The worm wheel 304 comprises three first projections 304*b* equally spaced in a rotational direction on one rotary surface 304*a* and second projections 304*d* (parenthesized in FIG. 18) similar to the first projections 304*b* on the other rotary surface 304*c* (opposite the rotary surface 304*a*).

The operating lever 306 comprises a first arm 306*a* with which one of the first projections 304*b* can come in contact at the side that faces the rotary surface 304*a* of the worm wheel 304 when the worm wheel 304 rotates counterclockwise from the lock position; a second arm 306*b* with which one of the second projections 304*d* can come in contact at the side that faces the rotary surface 304*c* when the worm wheel 304 rotates clockwise from the unlock position; and a lock detecting portion 306*c* that comes in contact with a lock detecting switch SW4 by rotating to the lock position.

By comprising the foregoing structure, the locking actuator AC1 acts as below. When the locking mechanism is in the unlock state, as shown by a solid line in FIG. 18, the first arm 306*a* of the operating lever 306 goes out of a rotating path of the first projection 304*b* of the worm wheel 304, and the second arm 306*b* comes within a rotating path of the second projection 304*d*. The first and second projections 304*b*, 304*d* rest out of the rotating path of the first and second arms 306*a*, 306*b*.

When the worm wheel 304 is rotated clockwise by the locking motor M1, the second projection 304*d* comes in contact with the second arm 306*b* clockwise, and the operating arm 306 rotates from the unlock position to the lock position. When the worm wheel 304 rotates clockwise through about 120 degrees, the first projection 304*b* (extending downward in FIG. 18) comes in contact with an end 306*ax* of the first arm 306*a*, thus preventing clockwise rotation and resting at the position. Thus, the locking mechanism turns to the lock state by rotating the output lever 20 that follows rotation of the operating lever 306, to the lock position.

When the output lever 20 is rotated from the unlock position to the lock position by locking the locking knob LK manually, each of the arms 306*a*, 306*a* of the operating lever 306 does not come in contact with the projections 304*b*, 304*d* of the worm wheel 304, so that the operating lever 306 can smoothly rotate from the unlock position to the lock position without reversing the worm wheel 306.

When the locking mechanism is in the lock state, the first arm 306*a* of the operating arm 306 comes within a moving path of the first projection 304*b* of the worm wheel 304, and the second arm 306*b* goes out of the moving path of the second projection. The first and second projections 304*b*, 304*d* rest out of the moving path of the first and second arms 306*a*, 306*b*.

When the worm wheel 304 is rotated counterclockwise by the locking motor M1, the first projection 304*b* comes in contact with the first arm 306*a* counterclockwise, and the operating lever 306 is rotated from the lock position to the unlock position. When the worm wheel 304 rotates counterclockwise through approximately 120 degrees, the second projection 304*d* comes in contact with an end 306*bx* of the second arm 306*b* and the worm wheel 304 is prevented from turning counterclockwise and rests at the position. Thus, the locking mechanism rapidly shifts by rotating the output lever 20 that follows rotation of the operating lever 306, to the unlock position.

In the foregoing lock state, when the output lever 20 is rotated from the lock position to the unlock position by unlocking the locking knob LK manually, each of the arms 306*a*, 306*b* of the operating lever 306 does not come in contact with each of the projections 304*b*, 304*d* of the worm wheel 304. Thus, the operating lever 306 can rotate from the lock position to the unlock position smoothly without reversing the worm wheel 306.

The release actuator AC2 comprises the release motor M2 and a reduction gear (not shown) that slows down the motor M2 in a casing 401. The release actuator AC2 also comprises an output lever 21 pivotally mounted outside the casing 401. When the locking mechanism is in the unlock state, the output lever 21 is actuated by the release motor M2, and the fully-open door latch unit DL3 and the fully-closed door latch unit DL2 are released via each of the elements of the locking mechanism to enable the door D to open and close. The release motor M2 is controlled by the control 200.

Inside the vehicle, the inside handle IH is fixed to the end of the inside-handle shaft 22 pivotally mounted to the base member 2. When the door D is opened by the inside handle IH, the inside handle IH swings backward (in an opening direction) from the neutral position in FIG. 2 through a predetermined angle, and when the door D is closed by the inside handle IH, the inside handle IH swings forward (in a closing direction) from the neutral position through a predetermined angle.

The inside lever 3 is pivotally mounted at the upper part of one side of the base member 2 via the inside handle shaft 22 to pivot with the inside handle IH and the inside lever 6. When the inside handle IH does not operate, the inside lever 3 is held in the neutral position with the inside handle IH by a spring 30 that acts on the inside subsidiary lever 6. When the door D is opened by the inside handle IH, the inside lever 3 moves clockwise in FIG. 8 from the neutral position in FIG. 4 against the spring 30. When the door D is closed by the inside handle IH, the inside lever 3 moves counterclockwise from the neutral position in FIG. 10.

Figure 16:
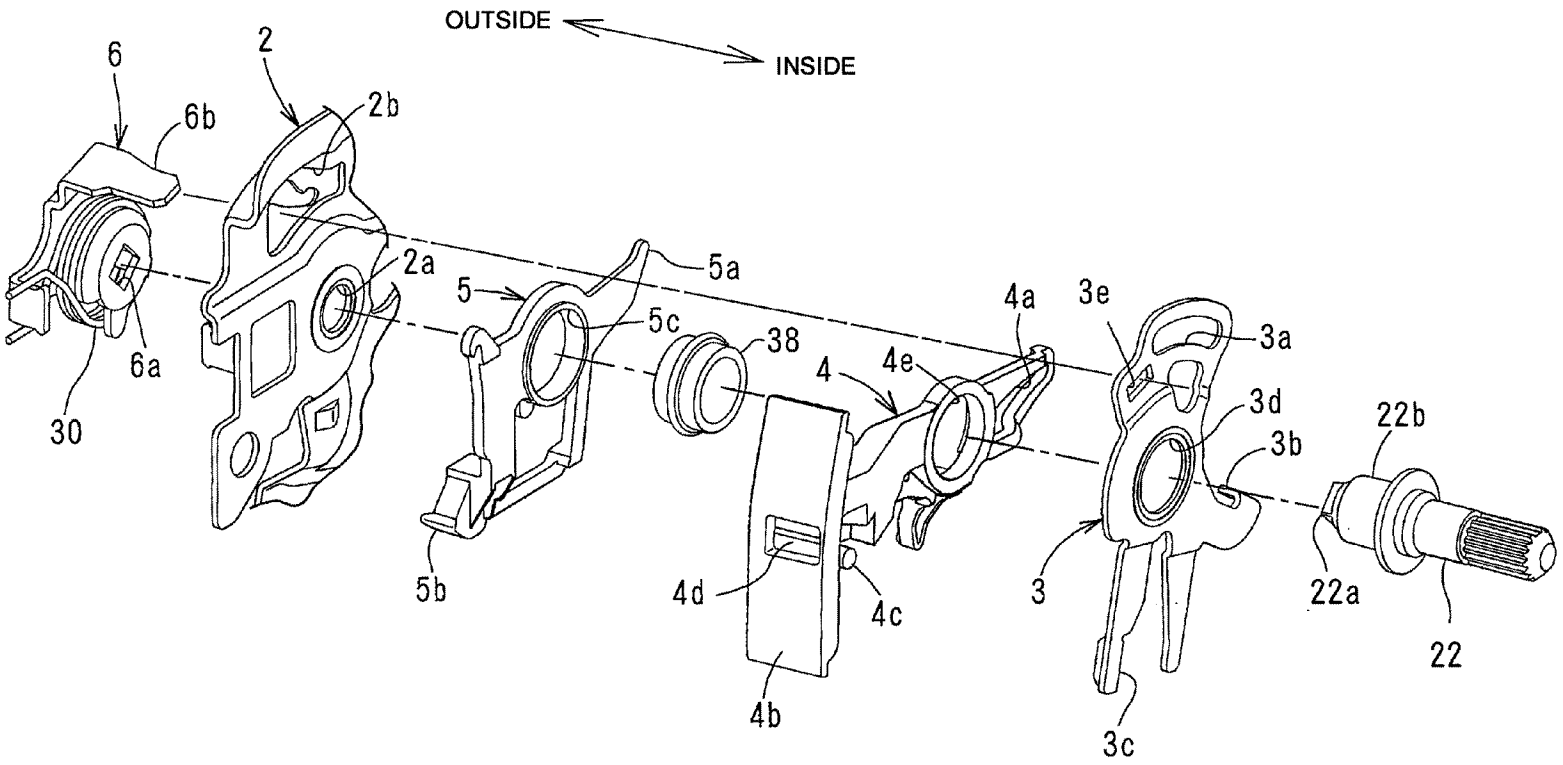
FIG. 16 is an exploded perspective view of the main part.
Figure 17:
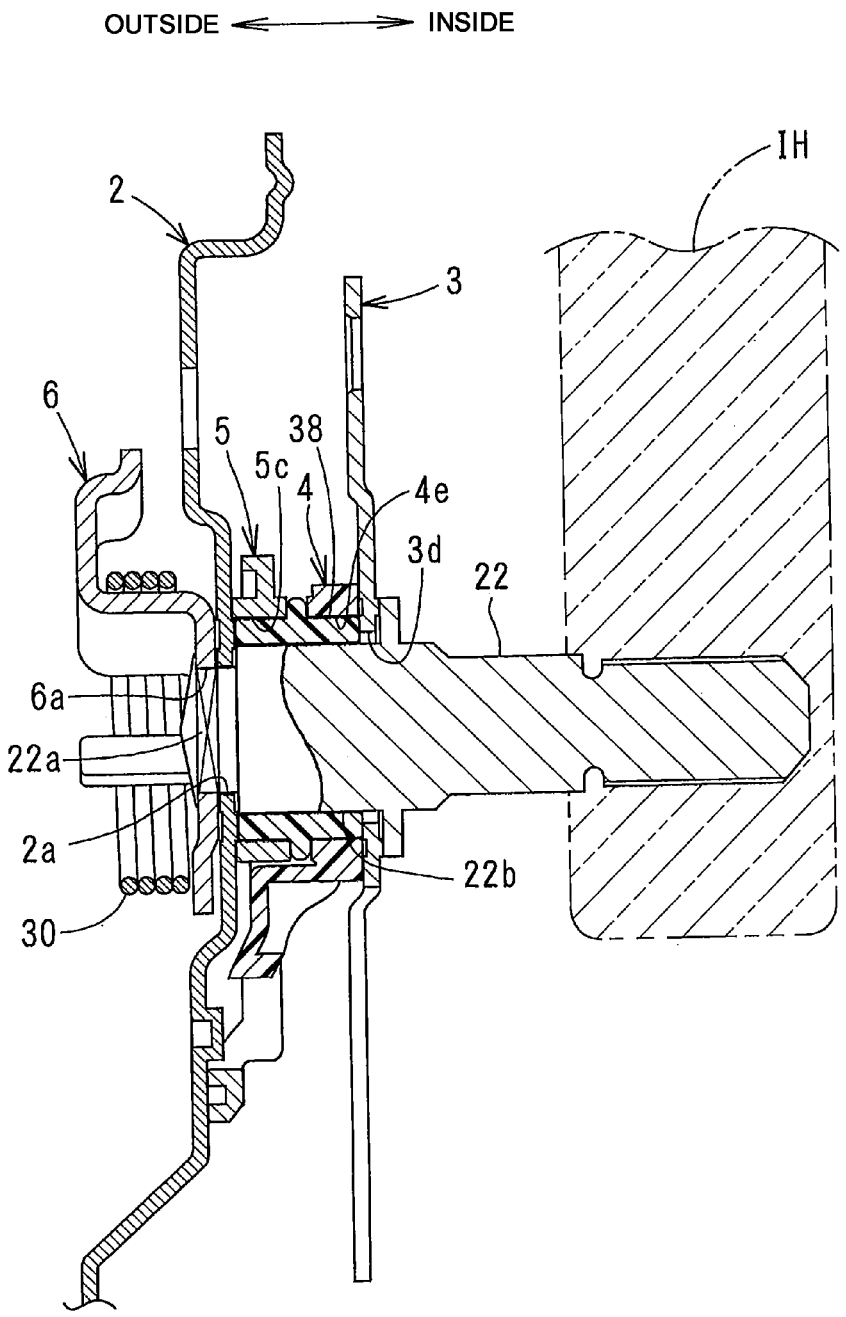
FIG. 17 is an enlarged vertical sectional view taken along the line XX in FIG. 2.

In FIGS. 16 and 17, a rectangular portion 22*a* of the inside handle shaft 22 which projects outward of the vehicle from a bearing hole 2*a* of the base member 2 fits in a rectangular hole 6*a* in the middle of rectangular portion 22*a* so that relative rotation is not possible. Hence, the inside subsidiary lever 6 is supported on the side facing the outside of the vehicle so that the inside subsidiary lever 6 may rotate with the inside-handle shaft 22. A cylindrical portion 22*b* of the inside handle shaft 22 is inserted in a bearing hole 3*d* in the middle of the inside lever 3, and a bent portion 6*b* of the inside subsidiary lever 6 engages in a hole 3*e* of the inside lever 3 through an arcuate elongate hole 2*b* of the base member 2, so that the inside lever 3 rotates with the inside handle shaft 22 via the inside subsidiary lever 6.

The inside handle shaft 22, the inside lever 3 and the inside subsidiary lever 6 rotate together by operating the inside handle IH. Thus, the inside lever 3 may be fixed directly to the inside handle shaft 22 without the inside subsidiary lever 6 without losing its function.

The front end of a connecting rod 51 coupled to the closing inside lever 13 is connected through an arcuate elongate hole 3*a* at the upper part to move relatively longitudinally of the vehicle to enable a closing action of the inside handle IH to be transmitted to the closing inside lever 13 via the connecting rod 51. Opening action of the inside handle IH moves the opening inside lever 8 counterclockwise by making a bent portion at the rear part contact a contact portion 8*a* of the opening inside lever 8, thereby moving the opening inside lever 8 counterclockwise for releasing in FIG. 8.

A slider 19 is supported up and down at the lower part of the inside lever 3. The slider 19 moves with movement of the childproof lock lever 4 and is in a childproof unlock position where the slider 19 comes within a moving path of an upper end 17*a* of the inside-handle detecting lever 17 when the childproof lock lever 4 is in the childproof unlock position in FIG. 14. The slider moves above the childproof unlock position and is in the childproof lock position where the slider 19 goes away from the moving path of the upper end 17*a*.

Figure 4:
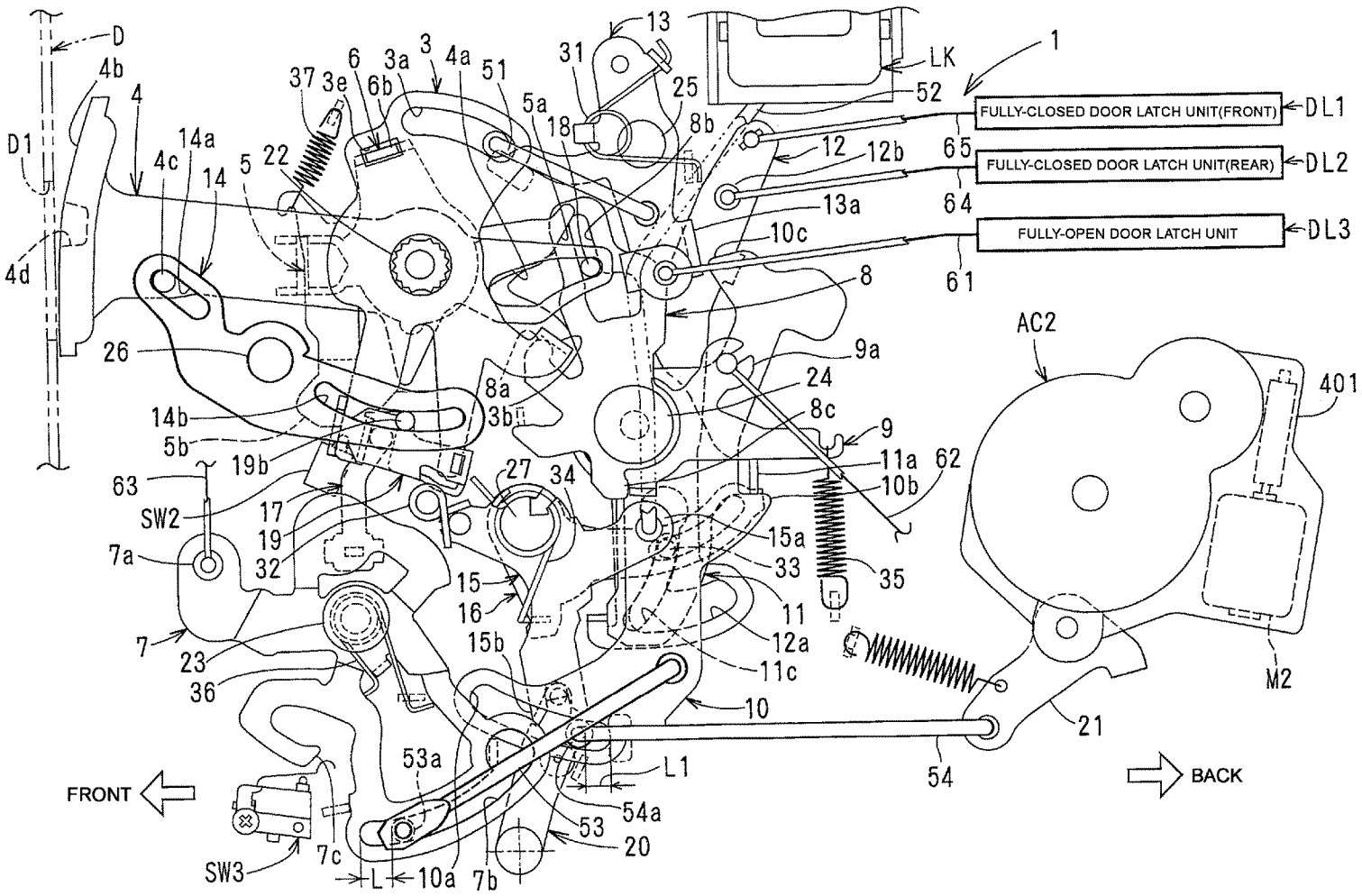
FIG. 4 is a front elevational view of the device viewed from the interior of the vehicle when the locking mechanism is in the unlock state and childproof mechanism is in the childproof unlock state.
Figure 5:
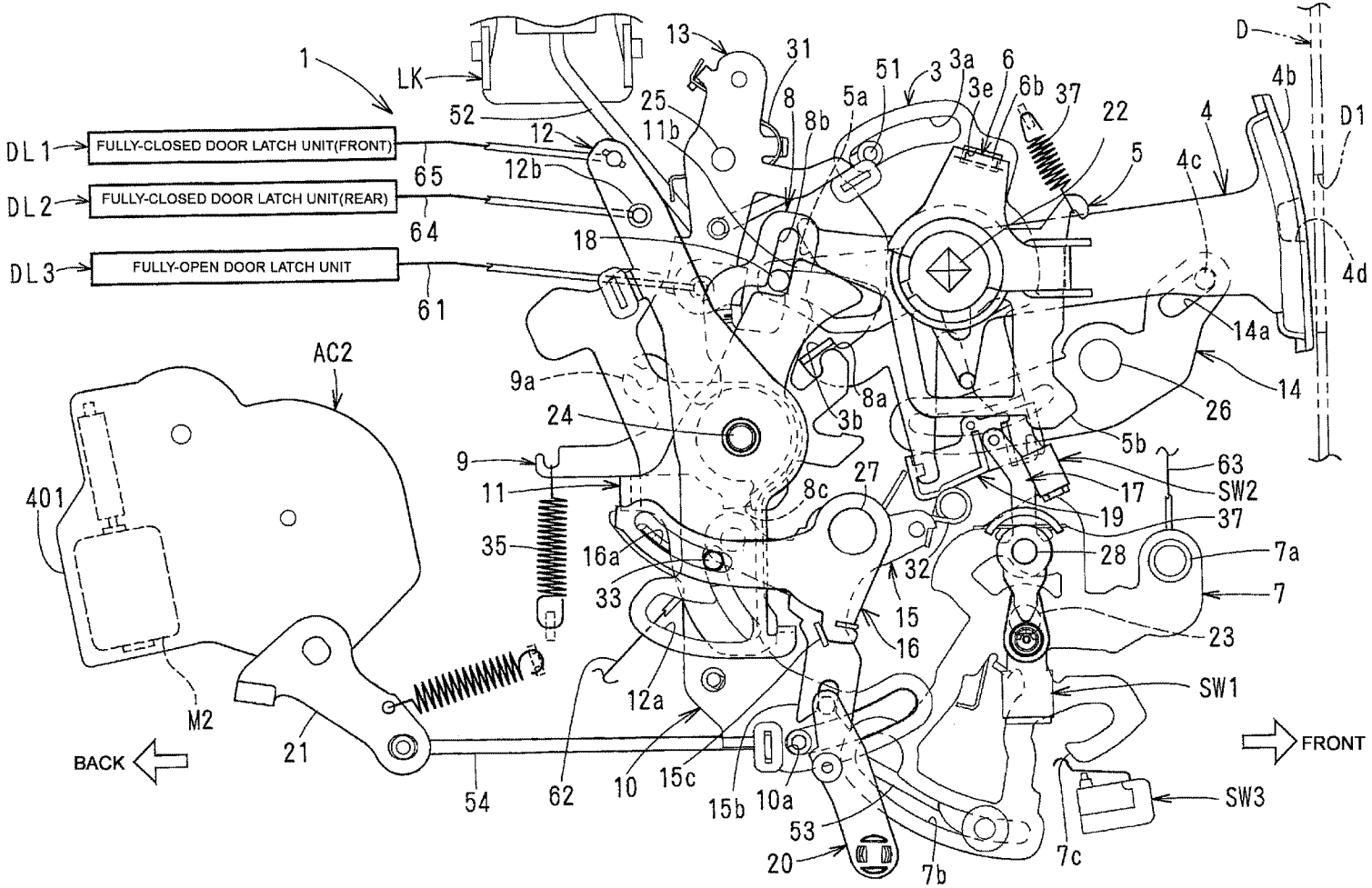
FIG. 5A is a back elevational view of FIG. 4.

The inside-handle detecting lever 17 is pivotally mounted via a shaft 28 to a switch case 40 fixed to the lower part of the base member 2 and can be rotated clockwise (counterclockwise in FIG. 5) against the spring 37 (FIG. 5) from the neutral position in FIGS. 4 and 5. The rotation is transmitted to the inside-handle detecting switch SW1.

The inside-handle detecting switch SW1 is included in the switch case 40. Clockwise or counterclockwise rotation of the inside-handle detecting lever 17 from the neutral position is transmitted to the inside-handle detecting switch SW1 which turns ON from OFF. The inside-handle detecting switch transmits an opening signal or a closing signal to the control 200 and triggers the electric door opening device 100.

The control 200 receives the opening signal from the inside-handle detecting switch SW1 and controls the electric-door opening device 100 to open the door D. Meanwhile, the control 200 receives the closing signal and controls the electric door opening device 100 to close the door D.

Figure 14:
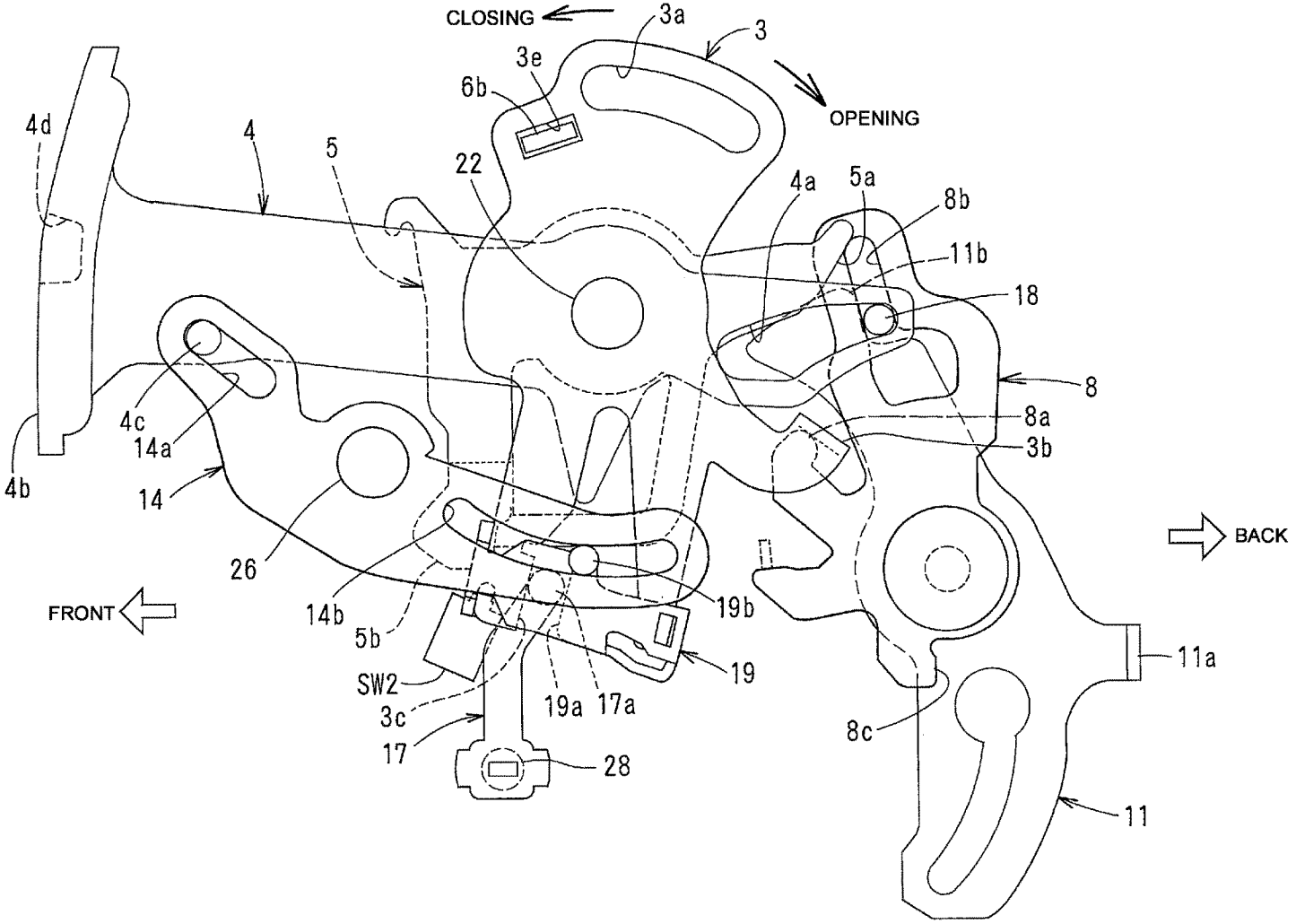
FIG. 14 is an enlarged front elevational view when the childproof mechanism is in the childproof unlock state.

In FIGS. 4 and 14, when the slider 19 is in the childproof unlock position or when the childproof mechanism is in the childproof unlock state, owing to opening action of the inside lever 3, the contact portion 19*a* of the slider 19 comes in contact with the upper end 17*a* of the inside-handle detecting lever 17 from back. Hence, the inside-handle detecting lever 17 is rotated from the neutral position in FIGS. 4 and 14 counterclockwise through a predetermined angle to turn the inside-handle detecting switch on. With closing action of the inside lever 3, a contact portion 3*c* at the lower part of the inside lever 3 comes in contact with the upper end from front, thereby rotating the inside-handle detecting lever 17 clockwise from the neutral position through a predetermined angle, so that the inside-handle detecting switch SW1 turns on.

Figure 7:
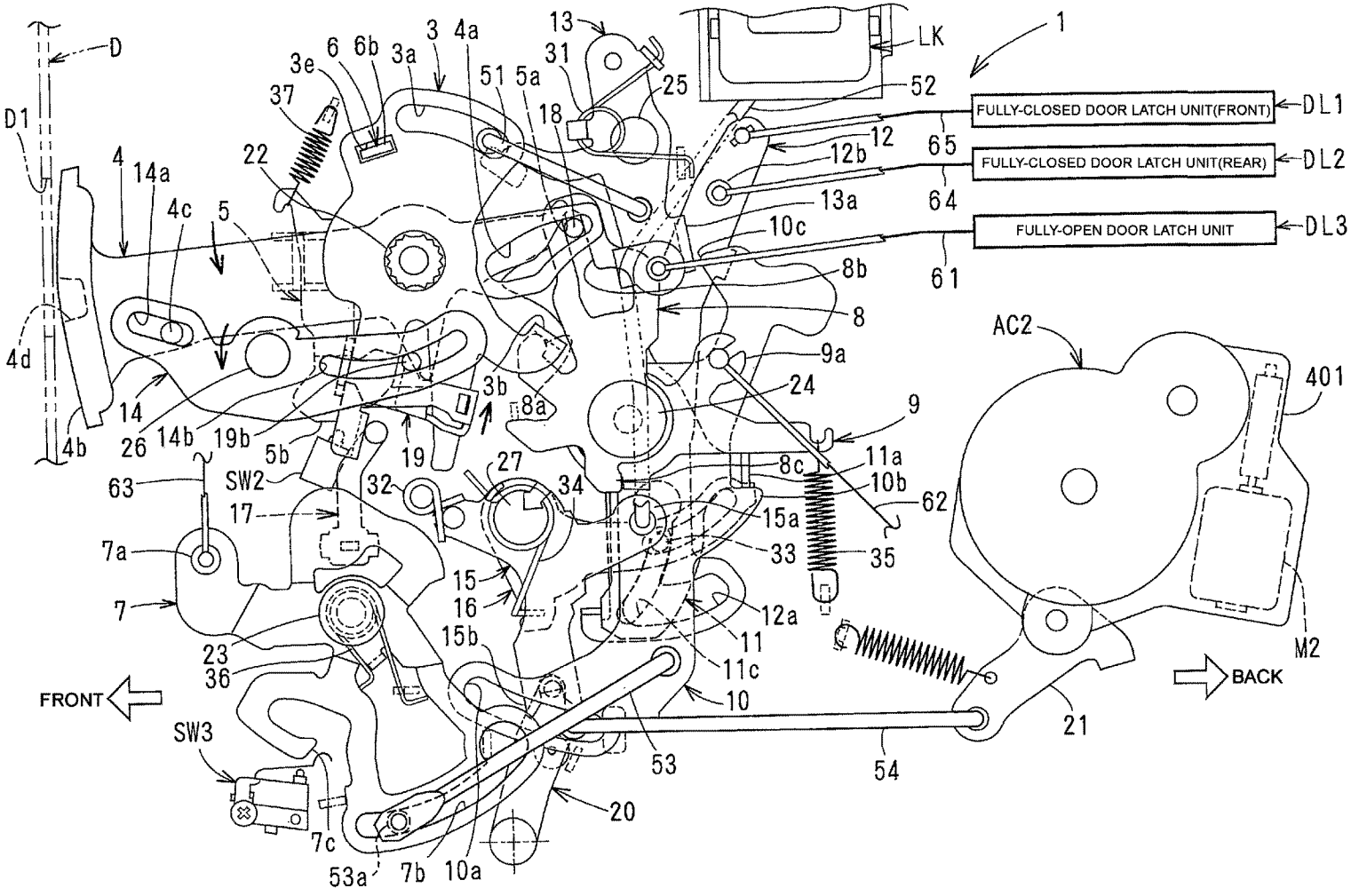
FIG. 7 is a front elevational view of the device when the locking mechanism is in the unlock state and the childproof mechanism is in the childproof lock state.

In FIGS. 7 and 14, when the slider 19 is in the childproof lock position or when the childproof mechanism is in the childproof lock state, the slider 19 goes out of the moving path of the upper end 17*a* of the inside-handle detecting lever 17. Therefore, even if the inside lever 3 is operated to open the door D, the inside-handle detecting lever 17 is held in the neutral position and the inside-handle detecting switch SW1 is not turned on or off. When the inside lever 3 is operated to close the door D, the contact portion 3*c* of the inside lever 3 comes in contact with the upper end 17*a* from front, thereby rotating the inside-handle detecting lever 17 clockwise from the neutral position through a predetermined angle, so that the inside-handle detecting switch SW1 is turned on.

When the childproof mechanism is in the childproof unlock state, the inside-handle detecting switch SW1 can turn on and transmit to the control 200 a signal that triggers the electric door opening device 100 based on door-opening/closing action of the inside lever 3. When the childproof mechanism is in the childproof lock state, the inside-handle detecting switch SW1 cannot transmit a signal that triggers the electric door opening device 100 based on door-opening action, but a signal that triggers the electric door opening device 100 can be transmitted to the control 200 only based on closing action.

The closing inside lever 13 is pivotally mounted to the base member 2 via the shaft 25, and the lower part of the closing inside lever 13 is connected to the elongate hole 3*a* of the inside lever 3 via the connecting rod 51. A contact portion 10*c* (later described) of the second outside lever 10 can come in contact with a bent portion 13*a* at the lower part from back. The lowest portion is connected to the fully-open door latch unit DL3 via a motion-transmitting member 61 such as a Bowden cable. The closing inside lever 13 moves clockwise in FIG. 10 from the initial position in FIG. 4 based on closing action of the inside lever 3 according to closing action of the inside handle IH and releasing action (later described) of the second outside lever 10 with the outside handle OH.

Figure 10:
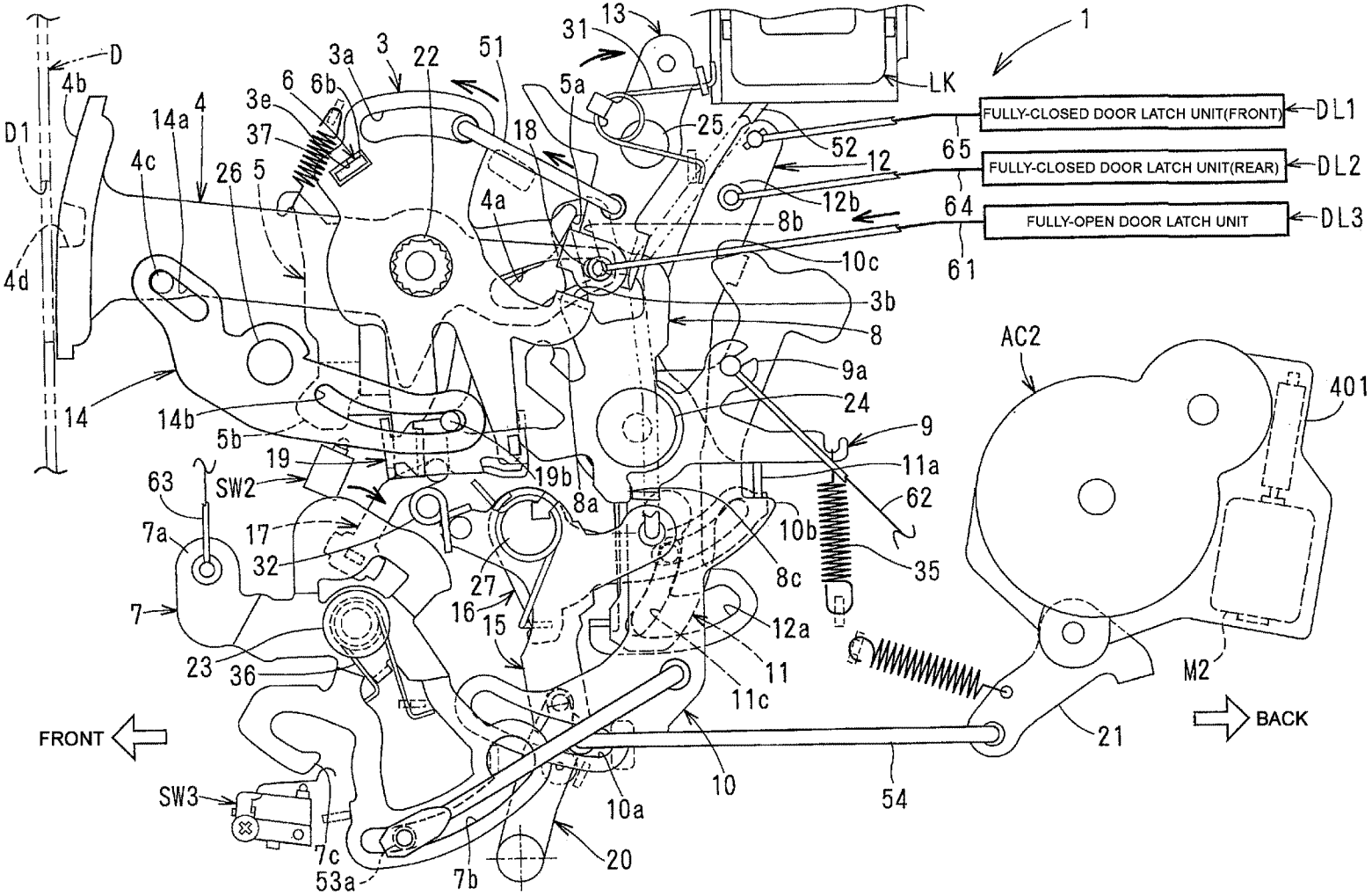
FIG. 10 is a front elevational view of the device in which the inside handle IH is operated to open the door when the locking mechanism is in the unlock state and the childproof mechanism is in the unlock state.

When the fully-open door latch unit DL3 engages with the striker to hold the door D fully open, the closing inside lever 13 performs releasing action in FIG. 10 according to closing action of the inside handle IH, and the releasing action is transmitted to the fully-open door latch unit DL3 via the motion transmitting member 61. The fully-open door latch unit DL3 disengages from the striker to enable the door D to move in a closing direction. When the inside lever 3 is operated to close the door D by the inside handle IH, the bent portion 3*b* of the inside lever 3 goes away from the contact portion 8*a* of the opening inside lever 8. Closing action of the inside lever is not transmitted to the opening inside lever 8.

The opening inside lever 8 is pivotally mounted to the base member 2 via the shaft 24, and the bent portion 3*b* comes in contact with the contact portion 8*a* from above according to clockwise opening action of the inside lever 3. According to opening action of the inside lever 3, the opening inside lever 8 moves for releasing counterclockwise in FIG. 8 from the initial position in FIG. 4.

Figure 8:
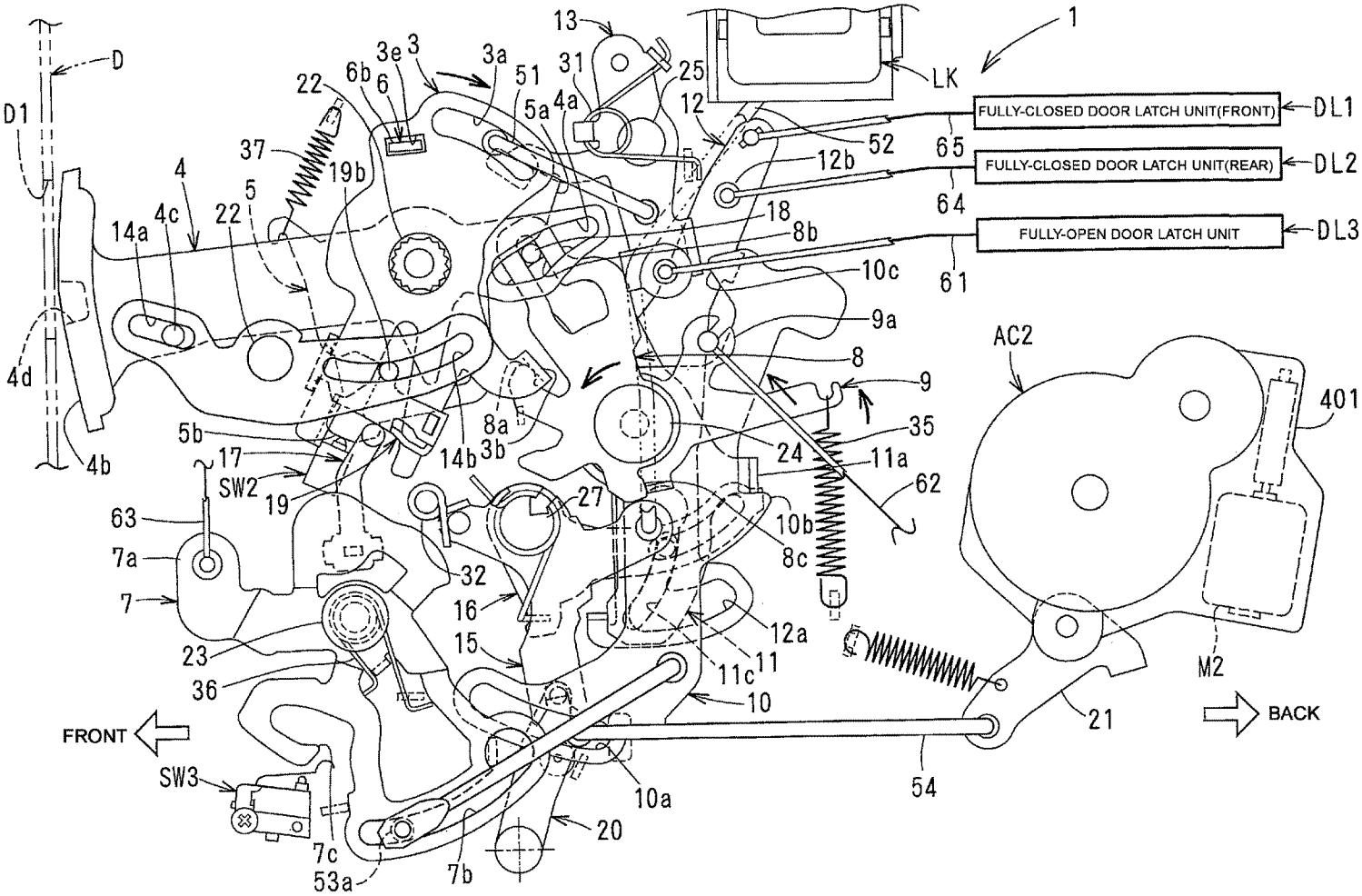
FIG. 8 is a front elevational view of the device in which an inside handle is operated to open a door when the locking mechanism is in the unlock state and the childproof mechanism is in the childproof unlock state.

In FIG. 8, releasing action of the opening release lever 8 is transmitted to the emergency lever 9 because a contact portion 8*c* at the lower part comes in contact with a part of the emergency lever 9 counterclockwise. When the childproof mechanism is in the childproof unlock state, the releasing action is transmitted to the subsidiary lever 11 via the engagement pin 18, and when the childproof mechanism is in the childproof lock state, it is not transmitted to the subsidiary lever 11.

The opening inside lever 8 has a vertical elongate hole 8*b* at the upper part. An engagement pin 18 fits in the elongate hole 8*b*, and moves between the childproof unlock position in FIGS. 4 and 14 where releasing action of the opening inside lever 8 can be transmitted to the subsidiary lever 11 and the childproof lock position in FIGS. 7 and 15 where it cannot be transmitted when the childproof lock lever 4 is in the childproof unlock position.

Figure 15:
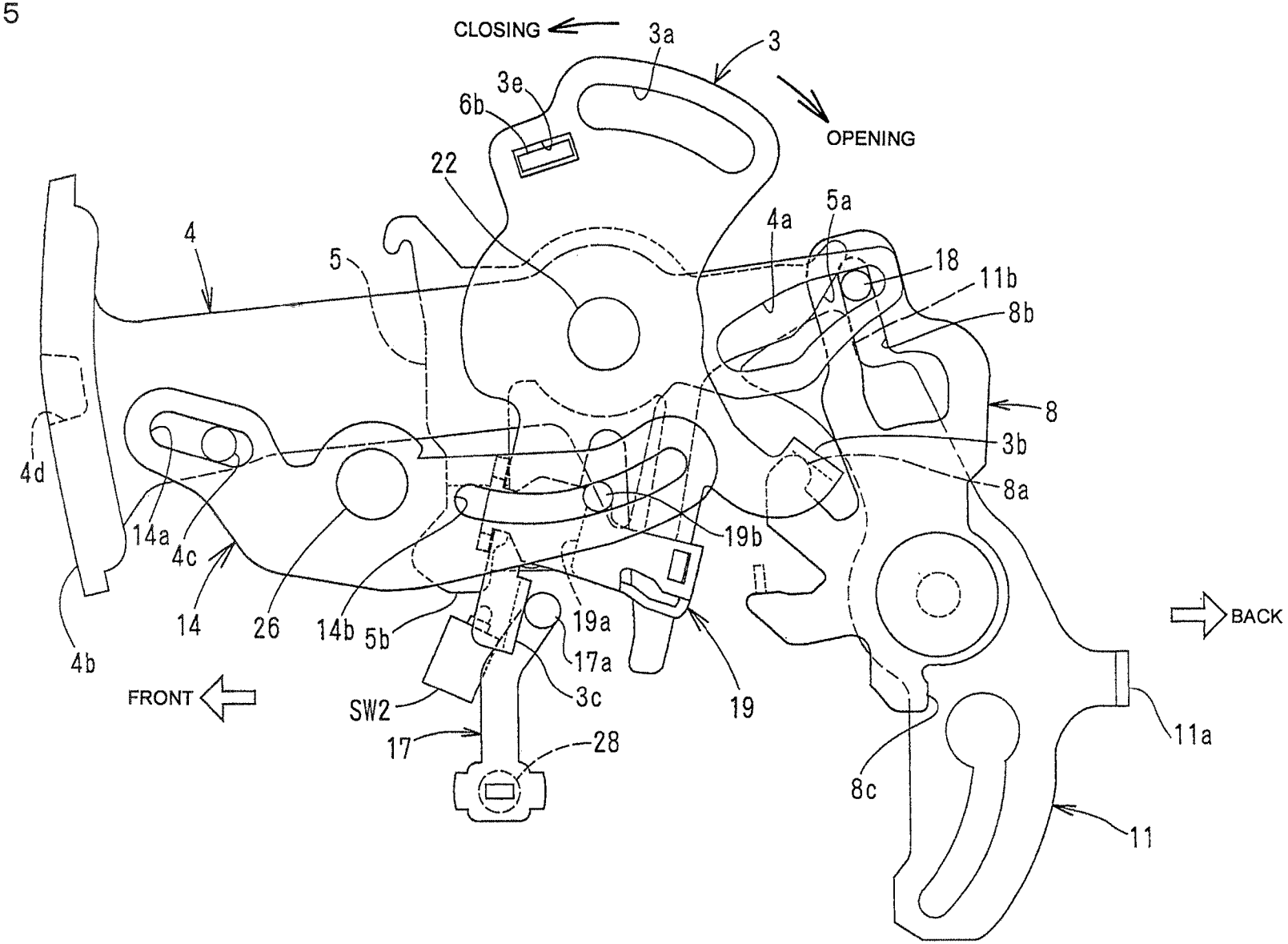
FIG. 15 is an enlarged front elevational view when the childproof mechanism is in the childproof lock state.

As clearly shown in FIGS. 14 and 15, the engagement pin 18 slides in a horizontal elongate hole 4*a* at the rear part of the childproof lock lever 4 and a vertical elongate hole 8*b* of the opening inside lever 8. Thus, in FIG. 14, when the childproof lock lever 4 is in a childproof unlock position, the engagement pin 18 is in a childproof unlock position in which the engagement pin 18 faces a contact portion 11*b* at the upper part of the subsidiary lever 11, and according to releasing action of the opening inside lever 8, the engagement pin 18 moves forward and comes in contact with the contact portion 11*b* from back. Hence, releasing action of the opening inside lever 8 is transmitted to the subsidiary lever 11. In FIG. 15, when the childproof lock lever 4 is in a childproof lock position, the engagement pin 18 moves upward from the childproof unlock position and is in the childproof lock position where it does not face the contact portion 11*b*. Releasing action of the opening inside lever 8 moves the engagement pin 18 forward, but the engagement pin 18 does not come in contact with the contact portion 11*b*, so that the releasing action of the opening inside lever 8 is not transmitted to the subsidiary lever 11.

The emergency lever 9 is pivotally mounted to the base member via a shaft 24, and a connecting portion 9*a* at the end is connected to an emergency mechanism (emergency lever) of the fully-closed door latch unit DL2 via a motion transmitting member 62. Whether the locking mechanism is in the unlock state or lock state, the emergency lever 9 rotates against a spring 35 counterclockwise according to opening action of the outside handle OH or inside handle IH from its initial position in FIG. 4 to FIG. 8. Releasing action is transmitted to the emergency mechanism of the fully-closed door latch unit DL2 via a motion transmitting member 62. The emergency mechanism cuts a transmission path between the closer mechanism and the latch mechanism of the fully-closed door latch unit DL2 to stop closing action.

Figure 12:
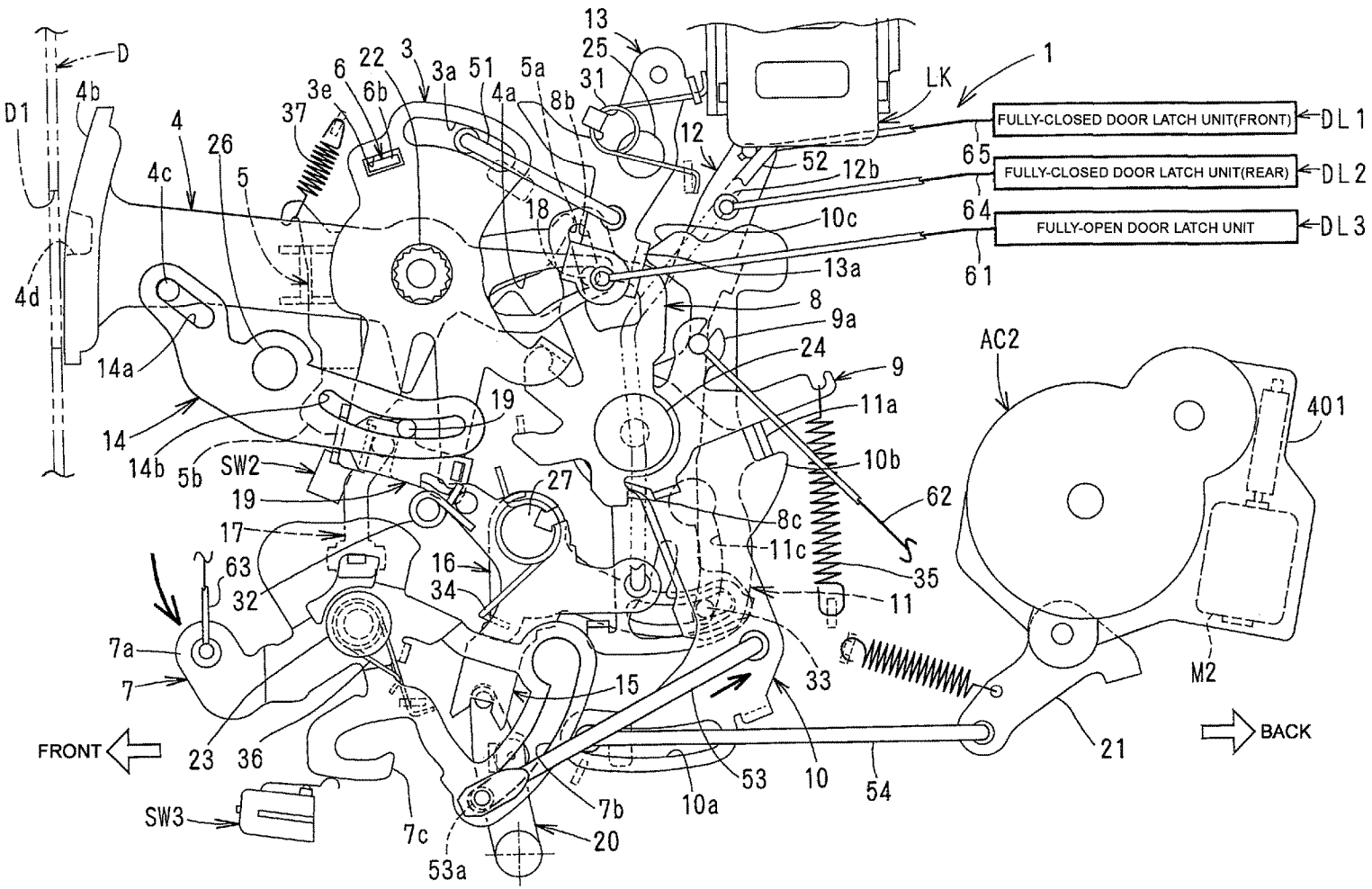
FIG. 12 is a front elevational view of the device in which the outside handle is operated when the locking mechanism is in the lock state and the childproof mechanism is in the childproof unlock state.

The first outside lever 7 is pivotally mounted to a switch case 40 via a shaft 23 or a first shaft disposed along the width of the vehicle. The lower end of a vertical motion transmitting member 63 of which the upper end is coupled to the outside handle OH is coupled to a connecting portion 7*a* at the front end of the first outside lever 7. The front end of a connecting rod 53 of which the rear end is coupled to the second outside lever 10 slides through an elongate hole 7*b* at the lower part of the first outside lever 7. By the outside handle OH, the motion transmitting member 63 is moved downward, and the first outside lever 7 is moved counterclockwise from its initial portion in FIG. 4 against a spring 36. In FIG. 12, the front end of the elongate hole 7*b* comes in contact with a front end 53*a* of the connecting rod 53 that slides through the elongate hole 7*b*, from front. Releasing action is transmitted to the second outside lever 10 via the connecting rod 53.

There is formed a play L in FIG. 4 between the front end of the elongate hole 7*b* of the first outside lever 7 and the front end 53*a* of the connecting rod 53. Thus, releasing action of the outside handle OH and the first outside lever 7 makes a stroke corresponding to the play L and is transmitted to the second outside lever 10 via the connecting rod 53.

The outside-handle detecting switch SW3 is off in FIG. 4 when the first outside lever 7 is in its initial position where the outside handle OH does not operate. When the first outside lever 7 makes a stroke releasing motion (hereinafter called "initial releasing motion") corresponding to the play from its initial portion in a releasing direction, the first outside lever 7 comes in contact with a detecting portion 7*c* of the first outside lever 7 on the way, so that the outside-handle detecting switch SW3 turns ON from OFF. While the first outside lever 7 makes a full-stroke releasing motion in FIG. 12 where the first outside lever 7 moves to the maximum rotating position, the outside-handle detecting switch SW3 is held ON. Each signal, ON signal or OFF signal, of the outside-handle detecting switch SW3 is transmitted to the control 200.

When the door D is closed or fully open, the control 200 carries out control of the release motor M based on ON signal of the outside-handle detecting switch SW3 and then control of the door opening motor M to control electric opening action or closing action of the door D. When the door D is closed and the locking mechanism is in the lock state, a regular user with an electronic key SW5 approaches a predetermined area around the vehicle. When ID signals are matched to authenticate that the regular user approaches the vehicle through wireless communication between the electronic key SW5 and a receiver 201 in the vehicle, based on operation for returning to the initial position after an opening action of the outside handle OH at the initial position made by the regular user, owing to turning the outside-handle detecting switch SW3 from OFF to ON/OFF, first, the locking motor M1 is controlled for unlocking to turn the locking mechanism to an unlock state, and then the fully-closed door latch units DL1, DL2 are released by the release motor M2, and the door D is opened by the door opening motor M. Unless ID signals are not identified, the control 200 carries out nothing even if the outside-handle detecting switch SW3 is turned from OFF to ON/OFF.

The second outside lever 10 is pivotally mounted to the base member 2 via a second shaft 24. A front end 54*a* of a connecting rod 54 coupled to an output lever 21 of the release actuator AC2 slides through an elongate hole 10*a* at the lower part of the second outside lever 10. The lower part of the second outside lever 10 is coupled to the first outside lever 7 via the connecting rod 53. With releasing action (counterclockwise in FIG. 4) of the outside lever 21 made by the release actuator AC2 and releasing action of the first outside lever 7, the second outside lever 10 rotates counterclockwise against the spring 35 from its initial position in FIG. 4 to carry out releasing action in FIG. 13. Because the play L is between the first outside lever 7 and the second outside lever 10, the first outside lever 7 moves for a distance corresponding to the play L and carries out releasing action.

Releasing action of the second outside lever 10 is transmitted to the subsidiary lever 11 because a pawl 10*b* of the second outside lever 10 comes in contact with a bent portion 11*a* of the subsidiary lever 11 from below. The contact portion 10*c* of the second outside lever 10 comes in contact with the bent portion 13*a* of the closing inside lever 13, and releasing action of the second outside lever 10 is transmitted to the closing inside lever 13 to make the closing inside lever 13 perform releasing action.

When the second outside lever 10 carries out releasing action based on releasing action of the first outside lever 7, the front end 54*a* of the connecting rod 54 merely moves through the elongate hole 10*a* of the second outside lever 10 relatively, so that releasing action of the second outside lever 10 is not transmitted to the output lever 21 of the release actuator AC2. When the second outside lever 10 performs releasing action based on the release actuator AC2, the front end 53*a* of the connecting rod 53 merely moves through the elongate hole 7*b* of the first outside lever 7 relatively, so that releasing action of the second outside lever 7 is not transmitted to the first outside lever 7.

The subsidiary lever 11 is pivotally mounted to the base member 2 via the shaft 24. The pawl 10*b* of the second outside lever 10 comes in contact with the bent portion 11*a* from below. With releasing action of the second outside lever 10 based on opening action of the outside handle OH, the subsidiary lever 11 performs releasing action to rotate counterclockwise against the spring 35 from its initial position in FIG. 4.

In FIG. 4, when the childproof lock lever 4 and the engagement pin 18 is in the childproof unlock position, forward movement of the engagement pin 18 with releasing action of the opening inside lever 8 comes in contact with the contact portion 11*b* of the subsidiary lever 11 from back, and releasing action of the opening inside lever 8 is transmitted to the subsidiary lever 11. When the door D is opened by the outside handle OH, the subsidiary lever 11 performs releasing action. Meanwhile, in FIG. 7, when the childproof lock lever 4 and the engagement pin 18 is in the childproof lock position, the engagement pin 18 is unable to come in contact with the contact portion 11*b*, so that releasing action of the opening inside lever 8 is not transmitted to the subsidiary lever 11.

At the lower part of the subsidiary lever 11, there is a vertical elongate hole 11*c* in which the engagement pin 33 of the locking mechanism vertically moves.

In addition to the elongate hole 11*c* of the subsidiary lever 11, the engagement pin 33 slides along an L-like control hole 12*a* that comprises a vertical portion and a horizontal portion that is continuous with the lower end of the vertical portion in the release lever 12 and along a horizontal elongate hole 16*a* in the second lock lever 16. When the second lock lever 16 is in the unlock position in FIG. 4, the engagement pin 33 is in the vertical portion of the control hole 12*a* and is in the unlock position where releasing action of the subsidiary lever 11 can be transmitted to the release lever 12, and when the second lock lever 16 is in the lock position in FIG. 6, the engagement pin 33 is in the horizontal portion of the control hole 12*a* and is in the lock position where releasing action of the subsidiary lever 11 cannot be transmitted to the release lever 12.

The release lever 12 is pivotally mounted to the base member 2 via the shaft 24. A connecting portion 12*b* at the upper part of the release lever 12 is connected to a release mechanism of the fully-closed door latch unit DL2 via a motion transmitting member 64 and to a release mechanism of the fully-closed door latch unit DL1. When the engagement pin 33 that slides along the L-like control hole 12*a*, the first lock lever 15 and the second lock lever 16 are in the unlock position and the locking mechanism is in the unlock state in FIG. 4, the release lever 12 moves counterclockwise from its initial position in FIG. 4 to FIG. 8 with releasing action of the subsidiary lever 11. When the engagement pin 33, the first lock lever 15 and the second lock lever 16 are in the lock position and the locking mechanism is in the lock state, the engagement pin 33 relatively moves through the horizontal portion of the control hole 12 in spite of releasing action of the subsidiary lever 11 and actually does not move from its initial position. Releasing action of the release lever 12 is transmitted to the fully-closed door latch units DL2, DL1 via the motion transmitting members 64, 65 to enable the door to open from the fully closed position.

The first lock lever 15 is pivotally mounted to the base member 2 via the shaft 27. A connecting portion 15*a* at the rear end of the first lock lever 15 is connected to the locking knob LK via a vertical connecting rod 52, and a connecting portion 15*b* at the lower end is connected to the upper end of the output lever 20 of the locking actuator AC1.

Figure 6:
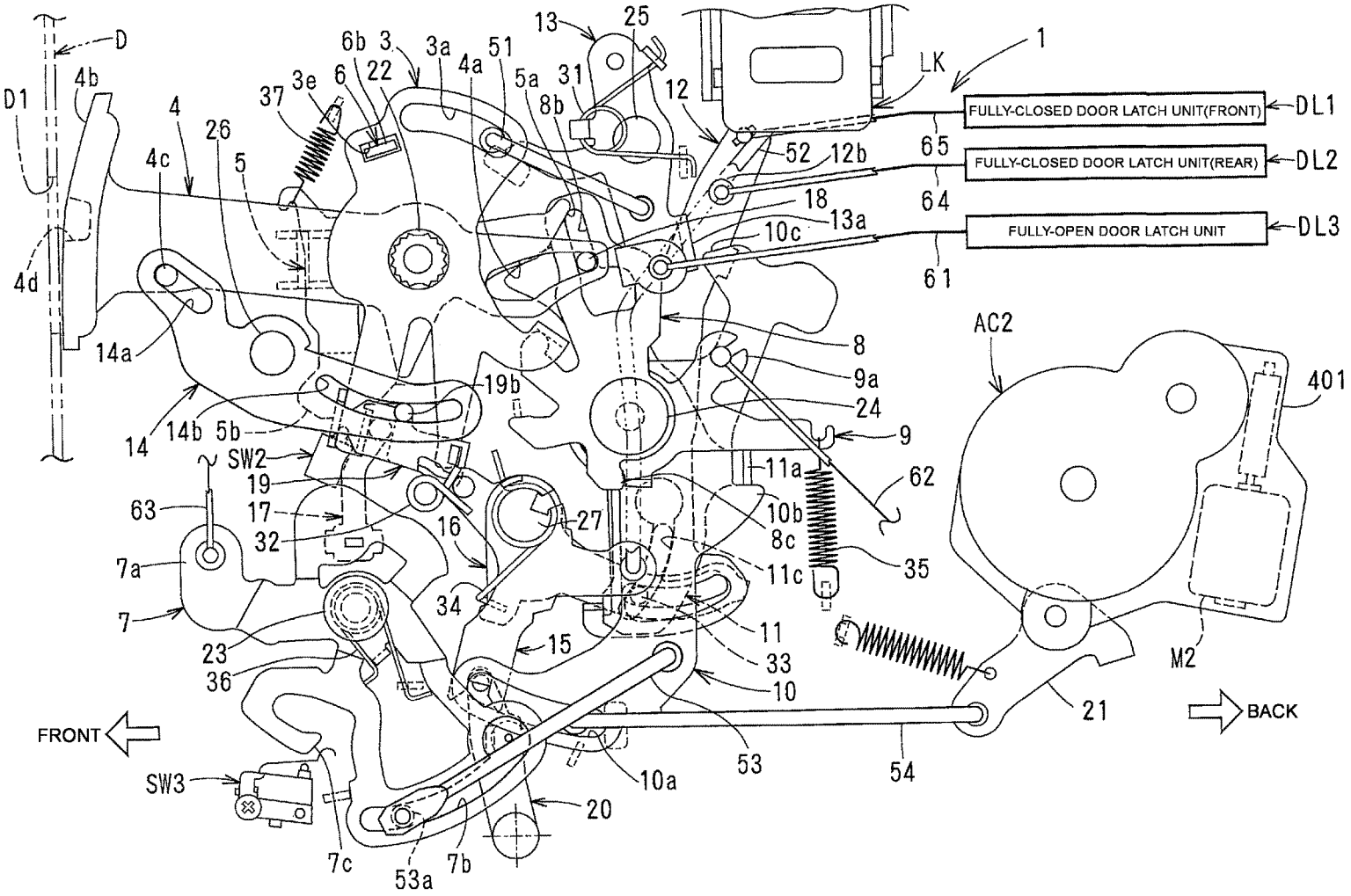
FIG. 6A is a front elevational view of the device when the locking mechanism is in the lock state and the childproof mechanism is in the childproof unlock state.

Hence, owing to manual operation of the locking knob LK and the output lever 20 with the locking actuator AC1, the first lock lever 15 moves to the unlock position in FIG. 4 for validating opening action of the outside handle OH and the inside handle IH against a turnover spring 32 supported on the base member 2 and to the lock position in FIG. 6 for invalidating it.

The second lock lever 16 is pivotally mounted to the base member 2 via the shaft 27 on a surface facing the inside of the vehicle and moves from the unlock position to the lock position with the first lock lever 15 because the second lock lever 16 comes in contact with a projection 15*c* of the first lock lever 15 in FIG. 5 when the first lock lever 15 moves from the unlock position to the lock position owing to manual operation of the locking knob LK or electric operation of the locking actuator AC1. When the first lock lever 15 moves from the lock position to the unlock position, the second lock lever 16 moves with the first lock lever 15 within the range of force of a spring 34 one end of which engages with the first lock lever 15 and the other end of which engages with the second lock lever 16. Force of the spring 34 that acts between the first lock lever 15 and the second lock lever 16 is set to be smaller than force of the turnover spring 32.

The second lock lever 16 has an elongate hole 16*a* along which the engagement pin 33 slides. When the second lock lever 16 is in the unlock position as mentioned above, the engagement pin 33 is in the unlock position in FIG. 4 where it fits in the vertical portion of the control hole 12*a* of the release lever 12. When the second lock lever 16 moves to the lock position, the engagement pin 33 moves to the lock position in FIG. 6 where it is in the horizontal portion of the control hole 12.

When the engagement pin 33 is in the unlock position, it comes in contact with the vertical portion of the control hole 12 counterclockwise according to releasing action of the subsidiary lever 11 in FIG. 8 to enable releasing action of the subsidiary lever 11 to be transmitted to the release lever 12. When the engagement pin 33 is in the lock position, it relatively moves through the horizontal portion of the control hole 12, so that releasing action of the subsidiary lever 11 is not transmitted to the release lever 12. Thus, when the locking mechanism is in the unlock state, the fully-closed door latch units DL2, DL1 according to opening action the outside handle OH and the inside handle IH, so that the door can be opened, but, when the locking mechanism is in the lock state, the door D cannot be opened based on opening action of the outside handle OH and the inside handle IH.

In the locking mechanism in this embodiment, the first lock lever 15 is separated from the second lock lever 16, but, if necessary, the first lock lever 15 may integrally be formed with the second lock lever 16.

In FIGS. 16 and 17, the childproof lock lever 4 is disposed closer to the outside of the vehicle than the inside lever 3 and is supported on an inside handle shaft 22 to rotate to each other because a cylindrical portion 22*b* of the inside handle shaft 22 is disposed in a bearing hole 4*e* via a collar 38 to rotate to each other. At the front end of the childproof lock lever 4, there is an operating portion 4*b* exposed through an operating hole D1 at the front end face of the door D when the door D is open, and at the rear end, there is an elongate hole 4*a* through which the engagement pin 18 mentioned above is fitted to move longitudinally of the vehicle. The operating portion 4*b* is operated for locking (downward in FIG. 4) while the door D is open, and the childproof lock lever 4 rotates around the shaft 22 counterclockwise through a predetermined angle from the childproof unlock position in FIG. 4 to the childproof lock position in FIG. 7. When the operating portion 4*b* is operated for unlocking (upward in FIG. 7), the childproof lock lever 4 rotates clockwise around the shaft 22 through a predetermined angle from the childproof lock position in FIG. 7 to the childproof unlock position in FIG. 4.

The operating portion 4*b* has a size enough to close the operating hole D1 from in the door D at any position. On the surface exposed through the operating hole D1, without projection, there is formed an operating groove 4*d* into which a finger can be inserted. The childproof lock lever 4 is operated while the finger is put in the operating groove 4*d* of the operating portion 4*b*.

In FIGS. 16 and 17, the switch lever 5 is disposed between the base member 2 and the childproof lock lever 4 and is mounted on the inside handle shaft 22 to rotate to each other because the cylindrical portion 22*b* of the inside handle shaft 22 fits through the bearing hole 5*c* via the collar 38 and can rotate to each other. The switch lever 5 has a contact portion 5*a* close to the engagement pin 18 at the end of a rearward arm and a detected portion 5*b* its motion of which is detected by the childproof detecting switch SW2.

When the childproof lock lever 4 is in the childproof unlock position, the engagement pin 18 is in the childproof unlock position in FIGS. 4 and 14 where the engagement pin 18 can come in contact with the contact portion 11*b* of the subsidiary lever 11 from back, but cannot come in contact with the contact portion 5*a* of the switch lever 5. When the childproof lock lever 4 is in the lock position, the engagement pin 18 is in a childproof lock position in FIGS. 7 and 15 where the engagement pin 18 cannot come in contact with the contact portion 11*b* of the subsidiary lever 11, but can come in contact with the contact portion 5*a* of the switch lever 5 from back.

Hence, when the childproof lock lever 4 is in the childproof unlock position, releasing action of the opening inside lever 8 can be transmitted to the subsidiary lever 11 via the engagement pin 18, but cannot be transmitted to the switch lever 5, and when the childproof lock lever 4 is in the childproof lock position, releasing action of the opening inside lever 8 cannot be transmitted to the subsidiary lever 11 via the engagement pin 18, but can be transmitted to the switch lever 5.

Releasing action of the opening inside lever 8 is transmitted to the switch lever 5 via the engagement pin 18 and rotates against the spring 37 from its initial position in FIGS. 4 and 14 counterclockwise as shown in FIG.

The childproof detecting switch SW2 is disposed in the switch case 40 and is usually OFF. When the childproof mechanism is in the childproof lock state, the switch lever 5 rotates in FIG. 9 and comes in contact with the detected portion 5*b* of the switch lever 5 to turn ON from OFF. The ON signal is transmitted to the control 200.

The childproof lock link 14 is pivotally mounted to the base member 2 via the shaft 26, and an elongate hole 14*a* at the front part is connected to a connecting stem 4*c* on the side of the childproof lock lever 4. An elongate hole 14*b* at the rear part is connected to a connecting stem 19*b* on the side of the slider 19. Thus, when the childproof lock lever 4 is in the childproof unlock position, the childproof lock link 14 is in a childproof unlock position in which the slider 19 is in a childproof unlock position in FIGS. 4 and 14. When the childproof lock lever 14 moves to the childproof lock position, the childproof lock link 14 rotates counterclockwise through a predetermined angle around the shaft 26 and moves to a childproof lock position in which the slider 19 is moved to a childproof lock position in FIGS. 7 and 15. That is to say, the childproof lock link 14 provides function for transmitting rotation of the childproof lock lever 4 to each position to the slider 19.

As mentioned above, the first outside lever 7 connected to the outside handle OH is pivotally mounted via the first shaft 23, and the second outside lever 10 connected to the release actuator AC2 is pivotally mounted via the second shaft 24, the first outside lever 7 does not overlap the second outside lever 10 in an axial direction, thereby making the operating unit thinner.

Figure 19:
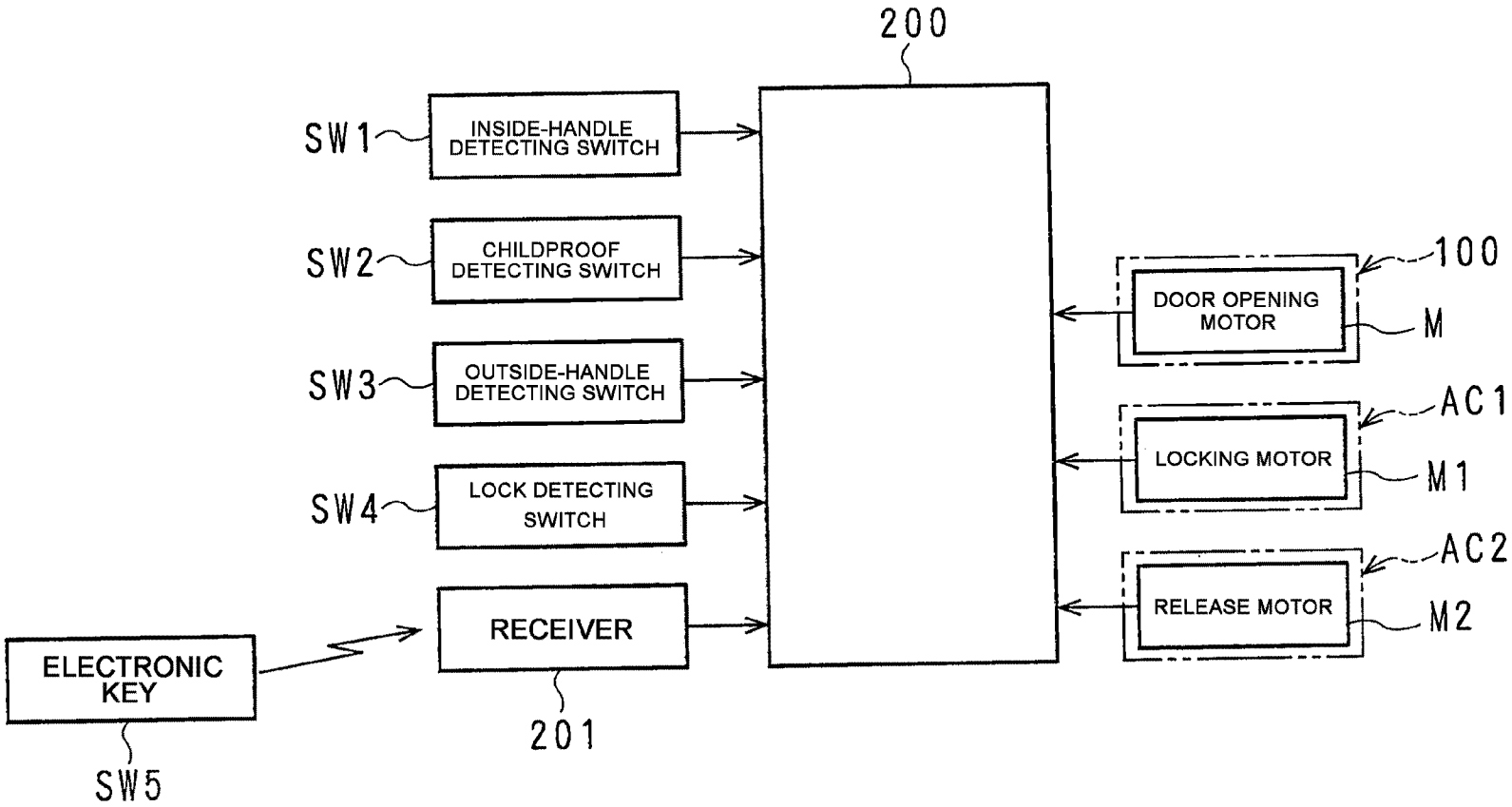
FIG. 19 is a block diagram of a control circuit in this invention.
Figure 20:
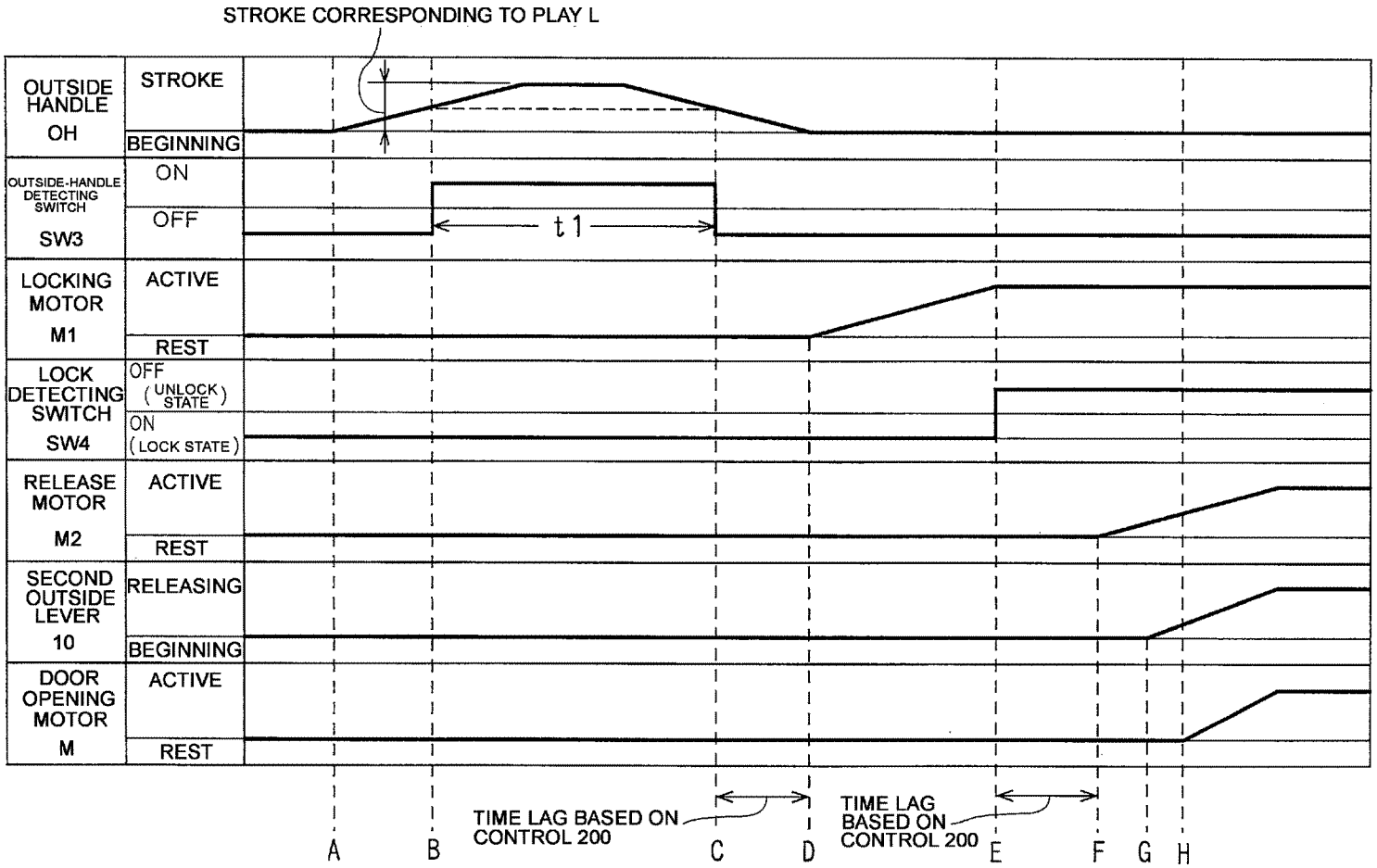
FIG. 20 is a timing chart describing operation of each element carried out according to action of the outside handle when the locking mechanism is in the lock state.

FIG. 19 is a block diagram of a control circuit for explaining the vehicle door opening device, and FIG. 20 is a timing chart for a control circuit.

The control 200 in the vehicle is electrically connected to a battery in the vehicle and controls electrical elements under computer program. Based on each signal, the door opening motor M, the locking motor M1 and the release motor M2 are controlled at a predetermined timing.

In FIG. 19, into input ports of the control 200, each signal is supplied from the inside-handle detecting switch SW1, the childproof detecting switch SW2, the outside-handle detecting switch SW3, the lock detecting switch SW4 and a receiver 201 that receives a signal transmitted from the electronic key SW5, and the door opening motor M, the locking motor M1 and the release motor M2 are electrically connected via each drive circuit (not shown) to output ports.

With FIG. 20, control is described when the door D is closed, when the locking mechanism is in the lock state and when a regular user with the electronic key SW5 approaches a predetermine area around the vehicle and it is authenticated that the regular user approaches to the vehicle with matching of ID signals through wireless communication between the electronic key SW5 and the receiver 201 in the vehicle.

When the control 200 authenticates the ID signal, the outside handle OH is operated by a regular user at timing A, and the first outside lever 7 rotates through a stroke corresponding to the play L as initial releasing action. The outside handle detecting switch SW3 turns ON from OFF at timing B.

The outside handle OH is operated through a predetermined stroke, and ON of the outside handle detecting switch SW3 continues for a predetermined time t1. The outside handle OH returns to its initial position, and the control 200 controls for unlocking at timing D because the outside-handle detecting switch SW3 turns to OFF at timing C. The outside handle OH returns to its initial position, so that all elements with action of the outside handle OH, the first outside lever 7, the connecting rod 53, the second outside lever 10, the subsidiary lever 11, the engagement pin 33, the closing inside lever 13 and the emergency lever 9, return to their initial positions.

The operating lever 306 of the locking actuator AC1 rotates from the lock position to the unlock position, the lock detecting switch SW4 turns from ON to OFF, and the locking mechanism turns from the lock state to the unlock state. Thus, based on an unlock signal (OFF signal) from the lock detecting switch SW4, the control 200 controls the release motor M2 at timing F. Hence, according to releasing action of the output lever 21, the release actuator AC2 moves the second outside lever 10 via the connecting rod 54, so that the fully-closed door latch units DL1, DL2 are released via the subsidiary lever 11, the engagement pin 33 and the release lever 12 to enable the door D to open at timing H.

The play L is formed between the front end 54*a* of the connecting rod 54 and the rear end of the elongate hole 10*a*. Thus, releasing action of the output lever 21 is transmitted to the second outside lever 20 at timing G after stroke rotation corresponding to the play L.

The control 200 detects that the door D can be opened at the timing H, and controls the door opening motor M. Thus, the door D can be opened by the electric opening device 100.

In the vehicle door opening device in this embodiment, when the door is closed and the locking mechanism is in the lock state, the regular user with the electronic key SW5 approaches a predetermined area around the vehicle, and the user operates the outside handle OH. The outside handle returns to its initial position after it is operated once, and the control 200 controls the locking motor M1 for unlocking, and turns the locking mechanism from the lock state to the unlock state. After completion of the turning, the release motor M2 is controlled for releasing to enable the door D to open. Thereafter, the door opening motor M is controlled to open the door D, enabling the door D to open owing to the electric door opening device 100 securely and reliably without losing operativity. Specifically, the vehicle door opening device in this embodiment simplifies the structure of the operating unit 1 and enables the door D to open securely and reliably because the locking mechanism is turned from the lock state to the unlock state owing to action of the outside handle OH with releasing action of the release actuator AC2. Thus, it is not necessary to provide the structure for preventing each element from interacting with each other.

In order to improve security, the control 200 is configured not to perform unlock control of the locking motor M1, release control of the release motor M2 and opening control of the door opening motor M when time t1 for detecting action of the outside handle OH owing to the outside handle detecting switch SW3 is shorter than predetermined time.

Motion of the operating unit 1 in this embodiment will be described with respect to FIGS. 4 to 15.

Figure 9:
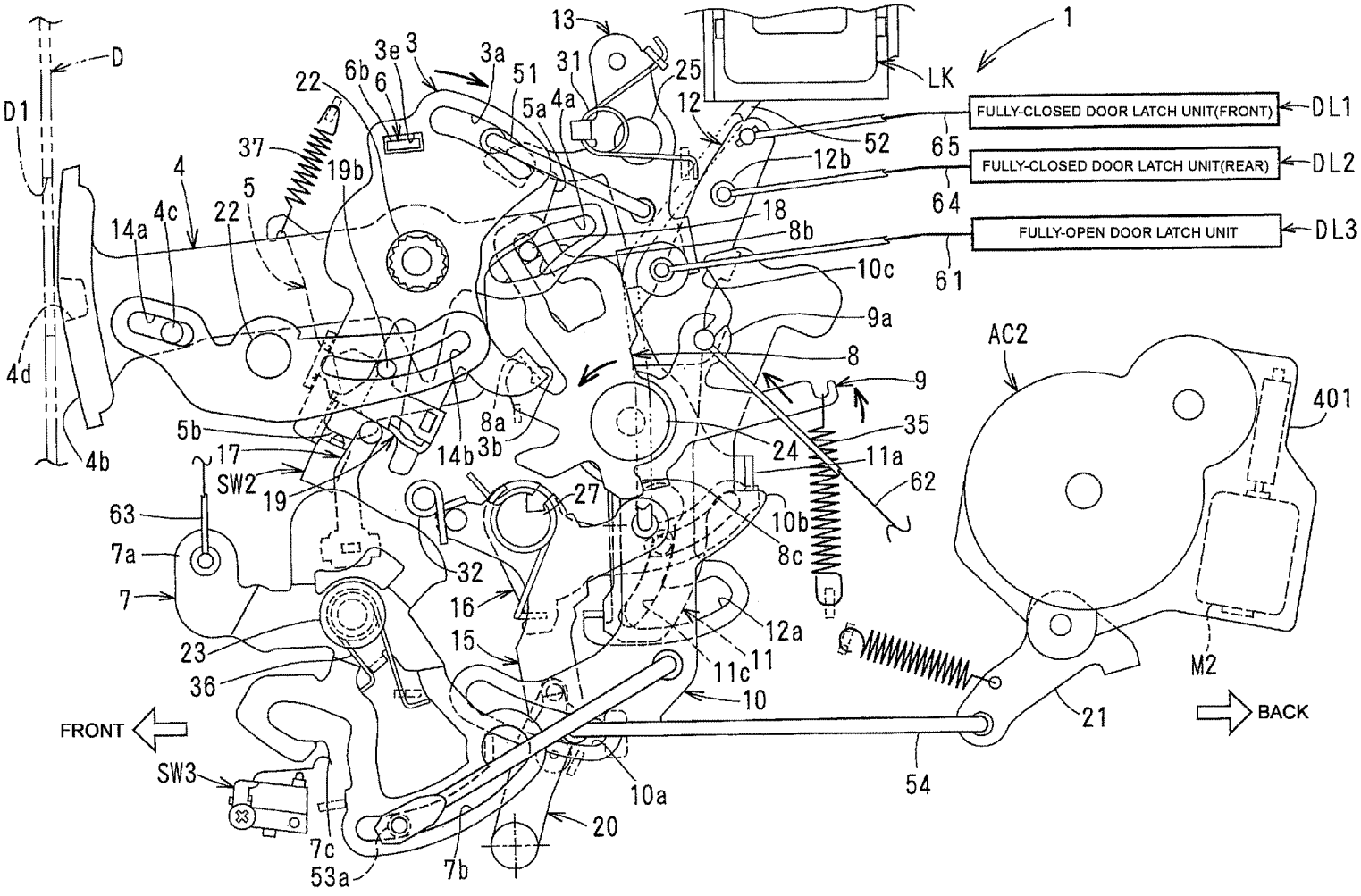
FIG. 9 is a front elevational view of the device in which the inside handle IH is operated to open the door when the locking mechanism is in the unlock state and the childproof mechanism is in the childproof lock state.
Figure 11:
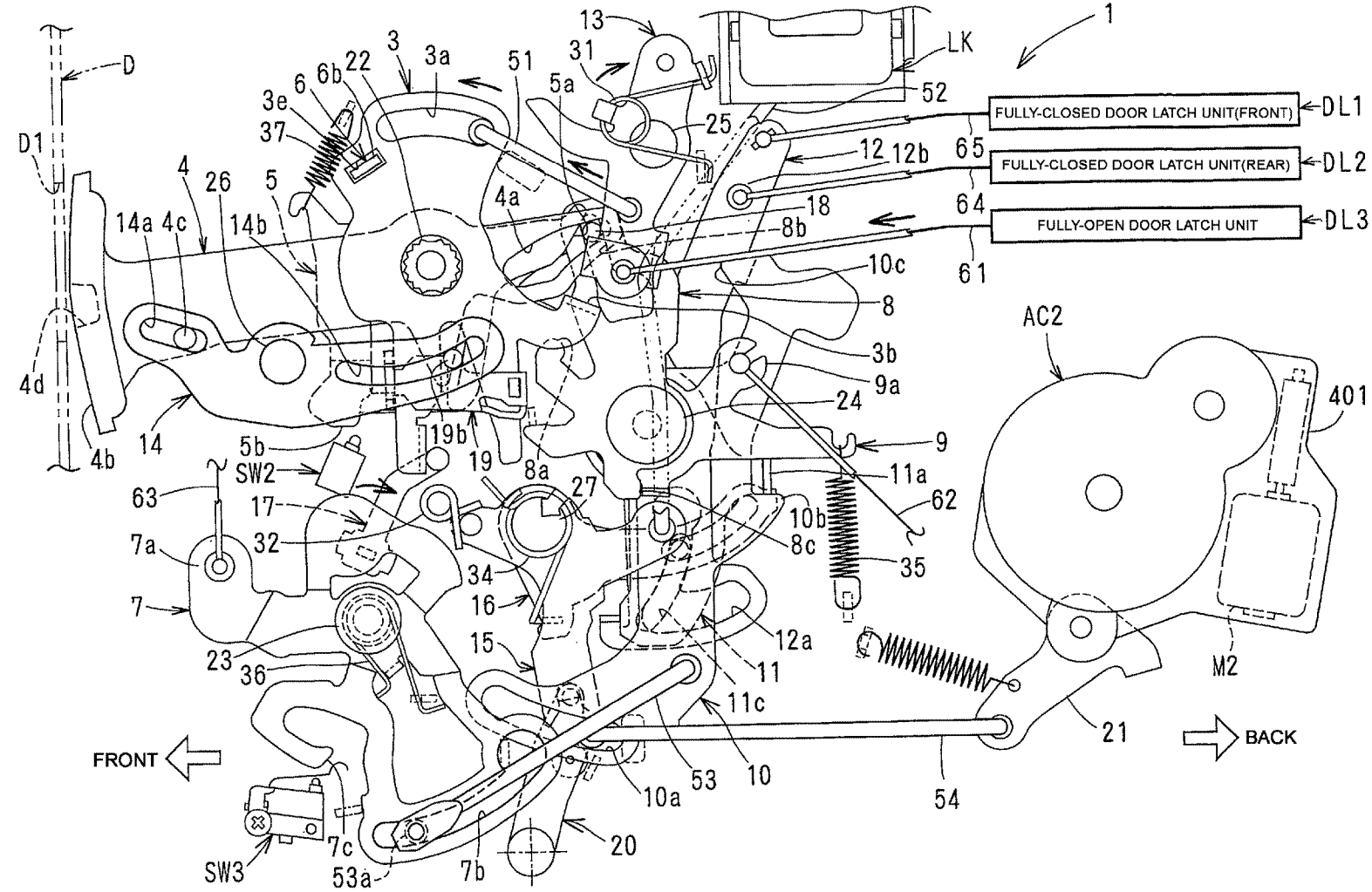
FIG. 11 is a front elevational view of the device in which the inside handle IH is operated to close the door when the locking mechanism is in the unlock state and the childproof mechanism is in the childproof lock state.
Figure 13:
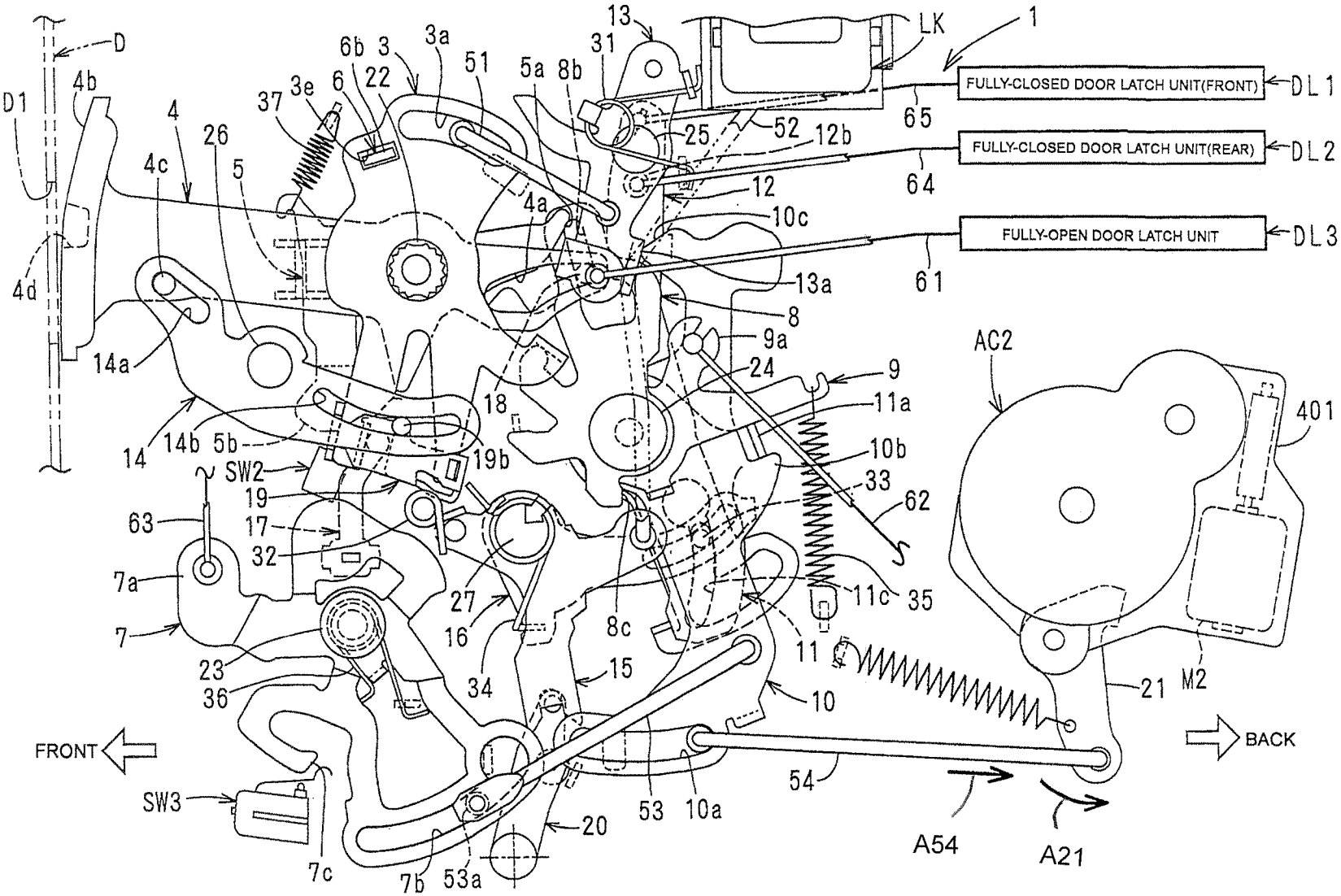
FIG. 13 is a front elevational view of the device in which a release actuator is operated for releasing when the locking mechanism is in the unlock state and the childproof mechanism is in the childproof unlock state.

FIG. 4 is a front elevational view viewed from the interior of the vehicle when the locking mechanism is in the unlock state and the childproof mechanism is in the childproof unlock state; FIG. 5 is a rear elevational view of the vehicle door opening device in FIG. 4 viewed from the interior of the vehicle; FIG. 6 is a front elevational view when the locking mechanism is in the lock state and the childproof mechanism is in the unlock state; FIG. 7 is a front elevational view when the locking mechanism is in the unlock state and the childproof mechanism is in the childproof lock state; FIG. 8 is a front elevational view in which the inside handle IH is operated to open the door D when the locking mechanism in the unlock state and the childproof mechanism is in the childproof unlock state; FIG. 9 is a front elevational view in which the inside handle is operated to open the door when the locking mechanism is in the unlock state and the childproof mechanism is in the childproof lock state; FIG. 10 is a front elevational view in which the inside handle is operated to close the door when the locking mechanism is in the unlock state and the childproof mechanism is in the childproof unlock state; FIG. 11 is a front elevational view in which the inside handle IH is operated to close the door when the locking mechanism is in the unlock state and the childproof mechanism is in the childproof lock state; FIG. 12 is a front elevational view in which the outside handle is operated when the locking mechanism is in the lock state and the childproof mechanism is in the childproof lock state; FIG. 13 is a front elevational view in which the release actuator AC2 is operated for releasing when the locking mechanism is in the unlock state and the childproof mechanism is in the childproof lock state; FIG. 14 is an enlarged front elevational view when the childproof mechanism is in the childproof unlock state; and FIG. 15 is an enlarged front elevational view when the childproof mechanism is in the childproof lock state.

The Outside Handle OH is Operated to Open the Door when the Door D is Fully Closed in FIG. 4 where the Locking Mechanism is in the Unlock State.

In FIG. 4, the outside handle OH is operated to open the door, and opening action is transmitted to the first outside lever 7 via the motion transmitting member 63. So, the first outside lever 7 is rotated counterclockwise around the shaft 23, releasing action is transmitted to the second outside lever 10 via the connecting rod 53, and the detected portion 7*c* comes in contact with the outside handle detecting switch SW3. The second outside lever 10 moves counterclockwise against the spring 35 around the shaft 24. Releasing action is transmitted to the subsidiary lever 11, the emergency lever 9 and the release lever 12. Releasing action of the release lever 12 is transmitted to the fully-closed door latch units DL2, DL1 via the motion-transmitting member 64. The fully-closed door latch units DL2, DL1 are released to enable the door D to open. The control 200 controls opening of the electric door opening device 100 based on an opening signal of the outside-handle detecting switch SW3.

In this case, because the lock mechanism is in the unlock state, the door D can be opened by the electric door opening device 100 owing to the outside handle OH whether or not an operator with the outside handle OH is a regular user with an electronic key.

The Inside Handle is Operated to Open the Door when the Door is in a Fully-Open Position in FIG. 4 where the Locking Mechanism is in the Unlock State.

In FIG. 4, the inside handle IH is operated to open the door. Opening action is transmitted to the inside lever 3 via the inside handle shaft 22. In FIG. 8, the inside lever 3 is moved counterclockwise from the neutral position around the inside handle shaft 22 against the spring 20. Releasing action is transmitted to the opening inside lever 8 via the bent portion 3*b* and to the inside-handle detecting switch SW1 via its contact portion 3*c* and the inside-handle detecting lever 17.

The opening inside lever 8 moves counterclockwise around the shaft 24 against the spring 35. Releasing action is transmitted to the engagement pin 18, the subsidiary lever 11, the release lever 12 and the emergency lever 9. With releasing action of the opening inside lever 8, the engagement pin 18 moves forward, but the engagement pin 18 is in a position where it cannot come in contact with the contact portion 5*a* of the switch lever 5. So the engagement pin 18 does not come in contact with the contact portion 5*a* even if it moves forward. Thus, the switch lever 5 does not operate.

The release lever 12 is moved with releasing action of the opening inside lever 8. Releasing action is transmitted to the fully-closed door latch unit DL2 via the motion-transmitting member 64 and to the fully-closed door latch unit DL1 via the motion-transmitting member 65. Thus, the fully-closed door latch units DL2, DL1 are released to enable the door D to open. The control 200 carries out opening control of the electric door opening device 100 based on an opening signal of the inside-handle detecting switch SW1.

The Outside Handle OH is Operated when the Door D is in the Fully-Closed Position in FIG. 6 in which the Locking Mechanism is in the Lock State.

In FIG. 6, a regular user with the electronic key SW5 approaches a predetermined area around the vehicle. When it is authenticated that the regular user approaches to the vehicle upon agreement in checking of wireless ID signals between the electronic key SW5 and the receiver 201, the outside handle OH is operated by the regular user, and the first outside lever 7 is rotated counterclockwise around the shaft 23 over the play L. Before releasing action of the first outside lever 7 is transmitted to the second outside lever 10, the detected portion 7*c* comes in contact with the outside-handle detecting switch SW3, which turns ON from OFF. An ON signal of the outside-handle detecting switch SW3 is transmitted to the control 200. At this time, the control 200 carries out nothing.

Because the locking mechanism is in the lock state this time, in FIG. 12, owing to releasing action of the first outside lever 7 with action of the outside handle OH, the second outside lever 10 and the subsidiary lever 11 performs releasing action, which is not transmitted to the release lever 12 because the engagement pin 33 of the locking mechanism is in the lock position.

The outside handle OH returns to the initial position, and the outside-handle detecting switch SW3 turns ON from OFF, and the first outside lever 7, the second outside lever 10 and the subsidiary lever 11 return to their initial positions. The locking actuator AC1 performs unlocking action to turn the locking mechanism to the unlock state.

In FIG. 13, the release actuator AC2 performs releasing action, and the output lever 21 and the connecting rod 54 move as shown by arrows A21, A54, respectively, thereby performing releasing action of the second outside lever 10, the subsidiary lever 11 and the release lever 12. Thus, when the fully-closed door latch units DL1, DL2 are released to enable the door D to open, the electric door opening device 100 is controlled for opening to open the door D. When the release actuator AC2 performs releasing action, releasing action is not transmitted to the first outside lever 7. The fully-closed door latch units DL1, DL2 are released by smaller force than the release actuator AC2 to enable the door D to open.

If there is no agreement in checking of ID signals on wireless communication between the electronic key SW5 and the receiver 201, the door D cannot be opened even if the outside handle OH is operated.

The Inside Handle IH is Operated to Open the Door when the Door D is Fully Closed in FIG. 6 where the Locking Mechanism is in the Lock State.

In FIG. 6, when the inside handle IH is operated to open the door, the opening action is transmitted to the inside lever 3 via the inside handle shaft 22. The inside lever 3 performs releasing action clockwise from the neutral position around the inside handle shaft 22 against the spring 20. The releasing action is transmitted to the opening inside lever 8 via the bent portion 3*b* and to the inside-handle detecting switch SW1 via the contact portion 3*c* and inside-handle detecting lever 17. Because the childproof lock lever 4 and the switch lever 5 are supported to rotate with the inside handle shaft 22 relatively, they do not rotate with rotation of the inside handle shaft 22 owing to action of the inside handle IH.

The opening inside lever 8 rotates counterclockwise against the spring 35 around the shaft 24 to perform releasing action. The releasing action is transmitted to the engagement pin 18, the subsidiary lever 11 and the emergency lever 9, but is not transmitted to the release lever 12 because the engagement pin 33 of the locking mechanism is in the lock position. In this state, forward motion of the engagement pin 18 owing to the releasing action of the opening inside lever 8 is not transmitted to the switch lever 5.

Thus, even if the inside handle IH is operated to open the door, the fully-closed door latch units DL2, DL1 cannot be released, so that the door D cannot be opened. The control 200 does not perform opening control of the electric door opening device 100 even if a signal is transmitted from the inside-handle detecting switch SW1.

The Outside Handle OH is Operated to Open the Door when the Door D is Fully Open in FIG. 7 where the Locking Mechanism is in the Unlock State.

When the outside handle OH is operated to open the door in FIG. 7, the opening action is transmitted to the first outside lever 7 via the motion-transmitting member 63. Releasing action of the first outside lever 7 is transmitted to the fully-closed door latch units DL2, DL1 via the connecting rod 53, the second outside lever 10, the subsidiary lever 11, the engagement pin 33, the release lever 12 and the motion-transmitting member 64. Thus, the fully-closed door latch units DL2, DL1 are released to enable the door D to open.

Because the locking mechanism is in the unlock state, the control 200 performs releasing control of the release motor M2 when the outside-handle detecting switch SW3 turns ON from OFF owing to action of the outside handle OH to enable the door D to open. Right after it, the electric door opening device 100 performs opening control.

The Inside Handle IH is Operated to Open the Door when the door D is Fully Closed in FIG. 7 where the Childproof Mechanism is in the Childproof Lock State.

When the inside handle IH is operated to open the door in FIG. 7, the opening action is transmitted to the inside lever 3 via the inside handle shaft 22. In FIG. 9, the inside lever 3 rotates clockwise from the neutral position around the inside handle shaft 22 against the spring 20 in FIG. 9. The releasing action is transmitted to the opening inside lever 8 via the bent portion 3*b*. The childproof lock lever 4 and the switch lever 5 do not rotate with rotation of the inside handle shaft 22 with operation of the inside handle IH because they are supported to relatively rotate with the inside handle shaft 22.

However, in the childproof lock state, in FIG. 9, the engagement pin 18 is in the childproof lock position where the engagement pin 18 cannot come in contact with the contact portion 11*a* of the subsidiary lever 11, but can come in contact with the contact portion 5*b* of the switch lever 5, and the slider 19 is in the lock position where the upper end 17*a* of the inside-handle detecting lever 17 cannot come in contact with the contact portion 19*b*. Thus, forward motion of the engagement pin 18 owing to releasing action of the opening inside lever 8 is not transmitted to the subsidiary lever 11, but is transmitted to the switch lever 5.

Thus, in FIG. 9, the switch lever 5 rotates around the inside handle shaft 22 counterclockwise with respect to the inside handle shaft 22, and the detected portion 5*b* of the switch lever 5 comes in contact with the childproof detecting switch SW2. Thus, the childproof detecting switch SW2 turns ON from OFF. Based on ON signal from the childproof detecting switch SW2, the control 200 controls the electric door opening device 100 so that opening control cannot be performed based on transmission of an ON signal from the childproof detecting switch SW2.

The Inside Handle IH is Operated to Close the Door when the Door D is Fully Open in FIG. 4 where the Childproof Mechanism is in the Childproof Unlock State.

In FIG. 4, the inside handle IH is operated to close the door, and closing action is transmitted to the inside lever 3 via the inside handle shaft 22. In FIG. 10, the inside lever 3 is moved counterclockwise from its neutral position against the spring 30 around the inside handle shaft 22, and the releasing action is not transmitted to the opening inside lever 8, but is transmitted to the opening inside lever 13. So, in the childproof lock state, even if the inside handle IH is operated to close the door, the closing action is not transmitted to the switch lever 5.

The closing inside lever 13 is moved clockwise from its initial position against the spring 31, and releasing action is transmitted to the fully-open door latch unit DL3 via the motion-transmitting member 61. Thus, the fully-open door latch unit DL3 is released and disengages from the striker to enable the door D to close.

The inside lever 3 is operated to close the door counterclockwise, and the contact portion 3*c* of the inside lever 3 comes in contact with the upper end 17*a* of the inside-handle detecting lever 17, which is rotated clockwise from its neutral position. Thus, the inside-handle detecting switch SW1 turns ON from OFF. Based on transmission of an ON signal from the inside-handle detecting switch SW1, the control 200 performs closing control of the electric door opening device 100.

The Inside Handle IH is Operated to Close the Door when the Door D is in the Fully-Open Position in FIG. 7 where the Childproof Mechanism is in the Childproof Lock State.

In FIG. 7, the inside handle IH is operated to close the door, and closing action is transmitted to the inside lever 3 via the inside handle shaft 22. In FIG. 11, the inside lever 3 is moved counterclockwise from its neutral position around the inside handle shaft 22 against the spring 30, and releasing action is not transmitted to the opening inside lever 8, but is transmitted to the closing inside lever 13.

The closing inside lever 13 is moved clockwise from its initial position against the spring 31, and releasing action is transmitted to the fully-open door latch unit DL3 via the motion transmitting member 61. Thus, the fully-open door latch unit DL3 is released and disengages from the striker to close the door D.

The inside lever 3 is moved counterclockwise to perform closing action. Even when the slider 19 is in the childproof lock position, the contact portion 3*c* of the inside lever 3 comes in contact with the upper end 17*a* of the inside-handle detecting lever 17 to make the inside-handle detecting lever 17 rotate clockwise from its neutral position. Thus, the inside-handle detecting switch SW1 turns ON from OFF, and the control 200 carries out opening control of the electric door opening device 100 based on transmission of ON signal from the inside-handle detecting switch SW1.

The Outside Handle OH is Operated when the Door is in the Fully-Open Position in FIG. 4 where the Locking Mechanism is in the Unlock State.

Whether a regular user or not, when the outside handle OH is operated, the outside-handle detecting switch SW3 turns ON from OFF, the control 200 does not perform drive control, but perform releasing drive control of the release motor M2. Then, it performs closing drive control of the door opening motor M.

The Outside Handle OH is Operated when the Door D is in the Fully-Open Position in FIG. 6 where the Locking Mechanism is in the Lock state.

Whether a regular user or not, as well as the fully-closed position of the door D, the outside handle OH returns to its initial position after it is operated. The control 200 performs unlocking control of the locking motor M1 to turn the locking mechanism from the lock state to the unlock state. After completion of the turning, the release motor M2 is controlled for releasing to enable the door D to open. Thereafter, the door opening motor M is controlled to close the door.

The Outside Handle OH is Operated when the Door D is between the Fully-Closed Position and the Fully-Open Position in FIG. 4 where the Locking Mechanism is in the Unlock State or in FIG. 6 where the Locking Mechanism is in the Lock State.

In order to improve security, whether the locking mechanism is in the unlock state or lock state, taking the opportunity that the outside-handle detecting switch SW3 turns ON by detecting the operation of the outside handle OH, the control 200 does not perform releasing control of the release motor M2, but performs the door opening motor closing control. Thus, the door D can be opened by the electric opening device 100 based on the operation of the outside handle OH.

What is claimed is:

1. A vehicle door opening device comprising:

door latch units that hold a door closed;

a release electric driving source that releases the door latch units to enable the door to open;

a door-opening electric driving source that can open and close the door;

an outside handle provided on an external side of the door;

a locking electric driving source;

an operating unit that comprises a locking mechanism that can be shifted by the locking electric driving source between an unlock state where an action of the outside handle can be transmitted to the door latch units and a lock state where the action of the outside handle cannot be transmitted; and a control that controls the release electric driving source, the door-opening electric driving source, and the locking electric driving source;

wherein the operating unit further comprises:

a first outside lever that is pivotally mounted to a base member via a first shaft and rotates in response to the action of the outside handle;

a second outside lever that is pivotally mounted to the base member via a second shaft differing from the first shaft, wherein the door latch units are released by a releasing action of the second outside lever caused by the release electric driving source, and wherein the second outside lever is connected to the first outside lever so that the releasing action of the second outside lever is not transmitted to the first outside lever; and a release lever that is pivotally mounted via the second shaft, wherein a releasing action of the release lever is caused by the releasing action of the second outside lever when the locking mechanism is in the unlock state, so that the releasing action of the release lever is transmitted to the door latch units.

2. The vehicle door opening device according to claim 1, wherein the second outside lever transmits its releasing action to the release lever via the locking mechanism when the locking mechanism is in the unlock state.

3. The vehicle door opening device according to claim 1, wherein, when the door is in a full-closed position and the locking mechanism is in the lock state, an outside-handle detecting switch detects a return of the outside handle after the outside-handle detecting switch detects the action of the outside handle, so that the control carries out an unlocking control of the locking electric driving source, a releasing control of the release electric driving source to cause the releasing action of the second outside lever, and an opening control of the door-opening electric driving source.

4. The vehicle door opening device according to claim 3, wherein, when the door is in the fully-closed position and the locking mechanism is in the unlock state, the outside-handle detecting switch detects the action of the outside handle, so that the control carries out the releasing control of the release electric driving source and the opening control of the door-opening electric driving source.

5. The vehicle door opening device according to claim 3, wherein, when the door is in a fully-open position, whether the locking mechanism is in the unlock state or in the lock state, the outside-handle detecting switch detects the action of the outside handle, so that the control carries out the releasing control of the release electric driving source and a closing control of the door-opening electric driving source.

6. The vehicle door opening device according to claim 3, wherein, when the door is in a position between a fully-open position and the fully-closed position, whether the locking mechanism is in the unlock state or the lock state, the outside-handle detecting switch detects action of the outside handle, so that the control does not carry out the releasing control of the release electric driving source, but carries out the opening control of the door-opening electric driving source.

7. The vehicle door opening device of claim 3, wherein, when a time for detecting the action of the outside handle with the outside-handle detecting switch is shorter than a predetermined time, the control does not carry out the unlocking control of the locking electric driving source, the releasing control of the release electric driving source, and the opening control of the door-opening electric driving source.

8. The vehicle door opening device according to claim 1, wherein the locking mechanism comprises a first lock lever that is pivotally mounted to the base member via a third shaft, a second lock lever that is pivotally mounted to the base member via the third shaft for the first lock lever and has an elongate hole, and an engagement pin that engages with the elongate hole of the second lock lever so as to be slidable relative to each other.

* * * * *